US012434871B2

(12) United States Patent
Boerret et al.

(10) Patent No.: US 12,434,871 B2
(45) Date of Patent: Oct. 7, 2025

(54) CLOSING DEVICE FOR CLOSING PHARMACEUTICAL CONTAINERS, AND SYSTEM FOR PROCESSING PHARMACEUTICAL CONTAINERS

(71) Applicant: Bausch + Ströbel SE + Co. KG, Ilshofen (DE)

(72) Inventors: Florian Boerret, Gaildorf (DE); Simon Ackermann, Frankenhardt (DE); Daniel Prozer, Groeningen (DE)

(73) Assignee: Bausch + Stroebel SE + Co. KG, Ilshofen (DE)

( * ) Notice: Subject to any disclaimer, the term of this patent is extended or adjusted under 35 U.S.C. 154(b) by 7 days.

(21) Appl. No.: 18/339,401

(22) Filed: Jun. 22, 2023

(65) Prior Publication Data

US 2023/0373671 A1 Nov. 23, 2023

Related U.S. Application Data

(63) Continuation of application No. PCT/EP2021/087364, filed on Dec. 22, 2021.

(30) Foreign Application Priority Data

Dec. 23, 2020 (DE) ..... 10 2020 134 792.8

(51) Int. Cl.
*B65B 7/28* (2006.01)
*B65B 3/00* (2006.01)

(52) U.S. Cl.
CPC ..... *B65B 7/2821* (2013.01); *B65B 3/006* (2013.01); *B65B 7/2807* (2013.01)

(58) Field of Classification Search
CPC ..... B65B 3/006; B65B 7/2807; B65B 7/2821
(Continued)

(56) References Cited

U.S. PATENT DOCUMENTS 3,453,804 A * 7/1969 Taylor et al. ..... B65B 7/2821 53/304
5,493,849 A 2/1996 Itoh
(Continued)

FOREIGN PATENT DOCUMENTS

DE 19716846 C1 11/1998
DE 10322476 A1 * 12/2004 ..... B65B 7/2807
(Continued)

OTHER PUBLICATIONS

Search Report received in International Application No. PCT/EP2021/087364 dated Apr. 13, 2022, with translation, 5 pages.

*Primary Examiner* — Stephen F. Gerrity
(74) *Attorney, Agent, or Firm* — Christopher A. Rothe; CM Law

(57) ABSTRACT

An apparatus for closing pharmaceutical containers with closure elements, and a system for processing pharmaceutical containers. The closure elements include a first face and a second face. The apparatus includes a feed unit with a feed path in which closure elements can be fed separately without contacting the first face; a receiving body with a receptacle for the closure element, the closure element being transferrable from the feed path into a receiving position in the receptacle; and a device for turning the receiving body from an initial position into an end position and transferring the closure element from the receiving position into a placed position in which the closure element is positioned on the container or at a distance to the container such that the first face points in the direction of the container interior.

28 Claims, 14 Drawing Sheets

(58) Field of Classification Search
USPC ..... 53/282, 306, 307, 308, 319
See application file for complete search history.

(56) References Cited

U.S. PATENT DOCUMENTS

| | | | | |
|---|---|---|---|---|
| 6,199,350 | B1 | 3/2001 | Brechel et al. | |
| 2006/0168916 | A1 | 8/2006 | Griebel et al. | |
| 2011/0271642 | A1 | 11/2011 | Monti | |
| 2011/0302883 | A1 | 12/2011 | Monti | |
| 2023/0002088 | A1 * | 1/2023 | Merz et al. | B65B 3/006 |

FOREIGN PATENT DOCUMENTS

| | | | | |
|---|---|---|---|---|
| EP | 1955949 | A1 | | 8/2008 |
| EP | 2394917 | A1 | | 12/2011 |
| JP | H01240492 | A | * | 9/1989 |

* cited by examiner

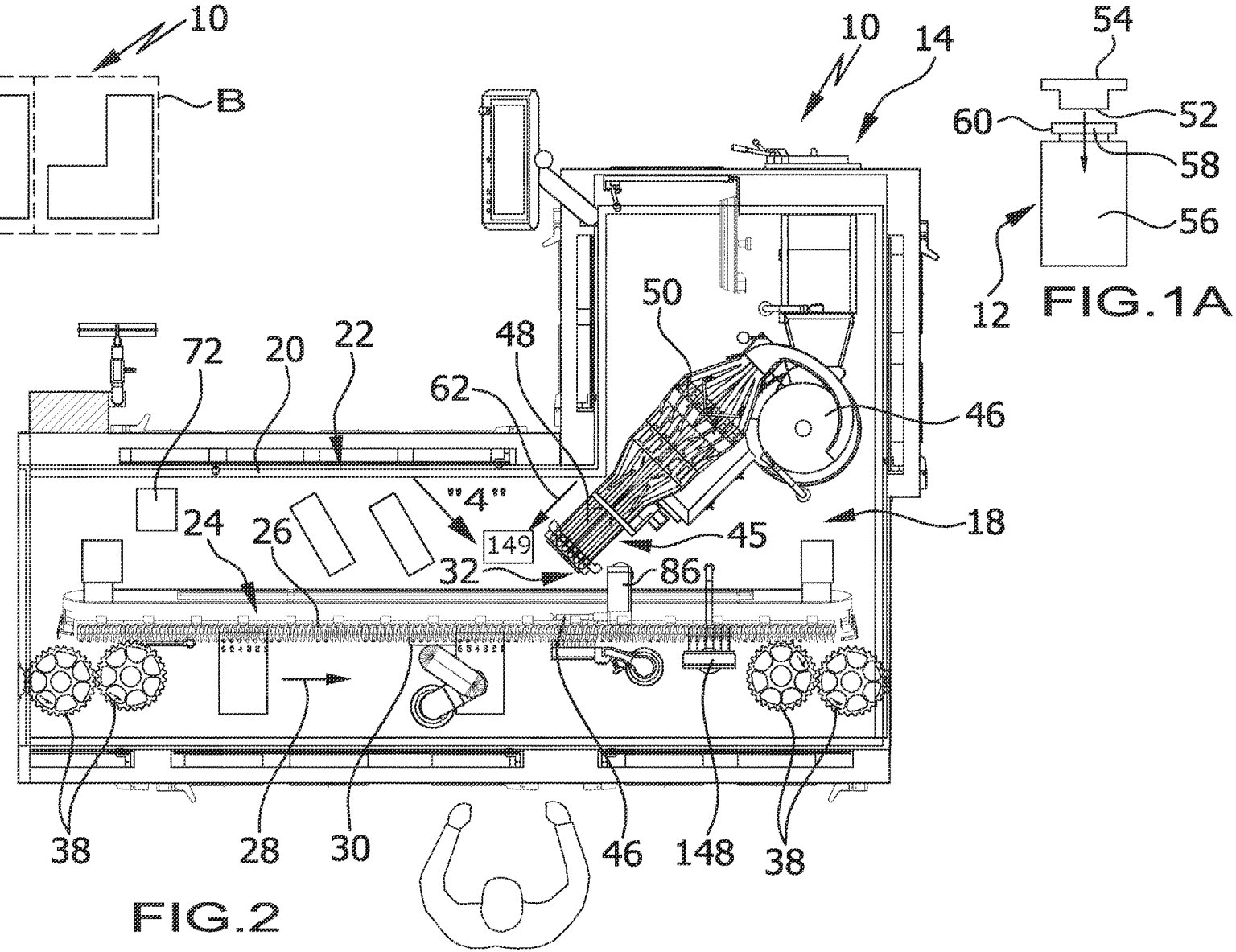
FIG. 1A
FIG. 2
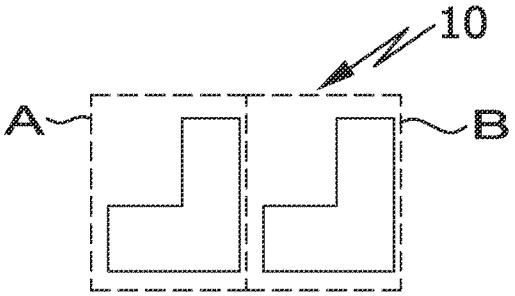
FIG. 1

85
52
34
54
64
48
62
80
90
98
104
102
92
94
76
96
78
32
74
68
100
108
110
112
70
106
66
36
45
86

181
132
58
60
180
178
114
12
128
56

132
136
138
74
78
85
86
132
118
114
48
180
28
45
96
76
12
94
92
80
12
82
108
68
120
122
26
88
18
84

CLOSING DEVICE FOR CLOSING PHARMACEUTICAL CONTAINERS, AND SYSTEM FOR PROCESSING PHARMACEUTICAL CONTAINERS

CROSS-REFERENCE TO RELATED APPLICATIONS

This application is a continuation patent application of international application number PCT/EP2021/087364, filed on Dec. 22, 2021, and claims the benefit of German application number 10 2020 134 792.8, filed on Dec. 23, 2020. The contents of international application number PCT/EP2021/087364 and German application number 10 2020 134 792.8 are incorporated herein by reference in their entireties and for all purposes.

FIELD

The present disclosure relates to a closing apparatus for closing pharmaceutical containers with closure elements, wherein the containers are, for example, vials, syringes or carpules.

Furthermore, the present disclosure relates to a system for processing pharmaceutical containers, for example vials, syringes or carpules, comprising at least one closing apparatus.

BACKGROUND

In such a system, pharmaceutical containers (also referred to as "vessels"), for example vials, syringes or carpules, are usually filled with a pharmaceutical substance via a filling station. The pharmaceutical substance is in particular a medically active substance (agent). After filling, the containers are closed with closure elements by means of the closing apparatus. For this purpose, vials (also known as "injection vials" or "phials") are usually closed with a closure element in the form of a mushroom plug. It may be provided that an additional closure element in the form of a crimp cap is added. Syringes can be closed, for example, by means of plunger stoppers. For closing carpules, plunger stoppers and/or combined crimp-stopper caps are used, for example, in which seals are integrated into the crimp caps (so-called "crimp cap with inserted seal").

With systems of the aforementioned type, in particular when processing toxic and highly sensitive pharmaceutical substances, so-called isolator devices are usually used (also referred to as "isolators"). The isolator device comprises a cover element which covers a set-down surface for the components of the system. In an atmosphere for protection and/or for decontamination purposes, for example consisting of a protective gas such as $H_2O_2$, the containers are filled and closed by means of the closure elements. It is known, for example, to lift the closure elements in such an environment from a supply by means of a vacuum device and a gripping element subjected to a negative pressure, place them on the containers, and press them on. The disadvantage in this case can be that the protective gas and/or the substance is suctioned in vapor form or powder form by the vacuum device. In the process, a considerable effort may be necessary to filter the suctioned media for safety reasons or, in the case of the protective gas, to feed it back to the environment.

An object underlying the present disclosure is to provide a closing apparatus for closing pharmaceutical containers and a system for processing pharmaceutical containers, which apparatus and system have greater operational safety.

SUMMARY

In a first aspect of the present disclosure, a closing apparatus for closing pharmaceutical containers with closure elements is provided. The closure elements comprise a first face and a second face and, when the container is closed with the closure element, the first face faces a container interior and the second face faces away from the container interior. The closing apparatus comprises a feed unit with a feed path in which closure elements can be fed separately and at least partly and preferably completely without contacting the first face. The closing apparatus further comprises a receiving body with a receptacle for the closure element, wherein the closure element can be transferred from the feed path into a receiving position in the receptacle, and a turning device for turning the receiving body from an initial position into an end position and transferring the closure element from the receiving position into a placed position in which the closure element is positioned on the container or at a distance from the container such that the first face points in the direction of the container interior.

In a second aspect of the present disclosure, a system for processing pharmaceutical container is provided, in particular vials, syringes or carpules. The system comprises a transport device for transporting the containers along at least one transport direction, a filling station arranged at the transport device for filling a pharmaceutical substance into the containers, and a closing apparatus, arranged downstream of the filling station in the transport direction, in accordance with the first aspect.

BRIEF DESCRIPTION OF THE DRAWINGS

The foregoing summary and the following description may be better understood in conjunction with the drawing figures, of which:

FIG. 1 is a schematic plan view of a system in accordance with the present disclosure for processing containers;

FIG. 1A is a schematic illustration of a pharmaceutical container and a closure element;

FIG. 2 is an enlarged detail view of section A in FIG. 1;

DETAILED DESCRIPTION

Figure 3:
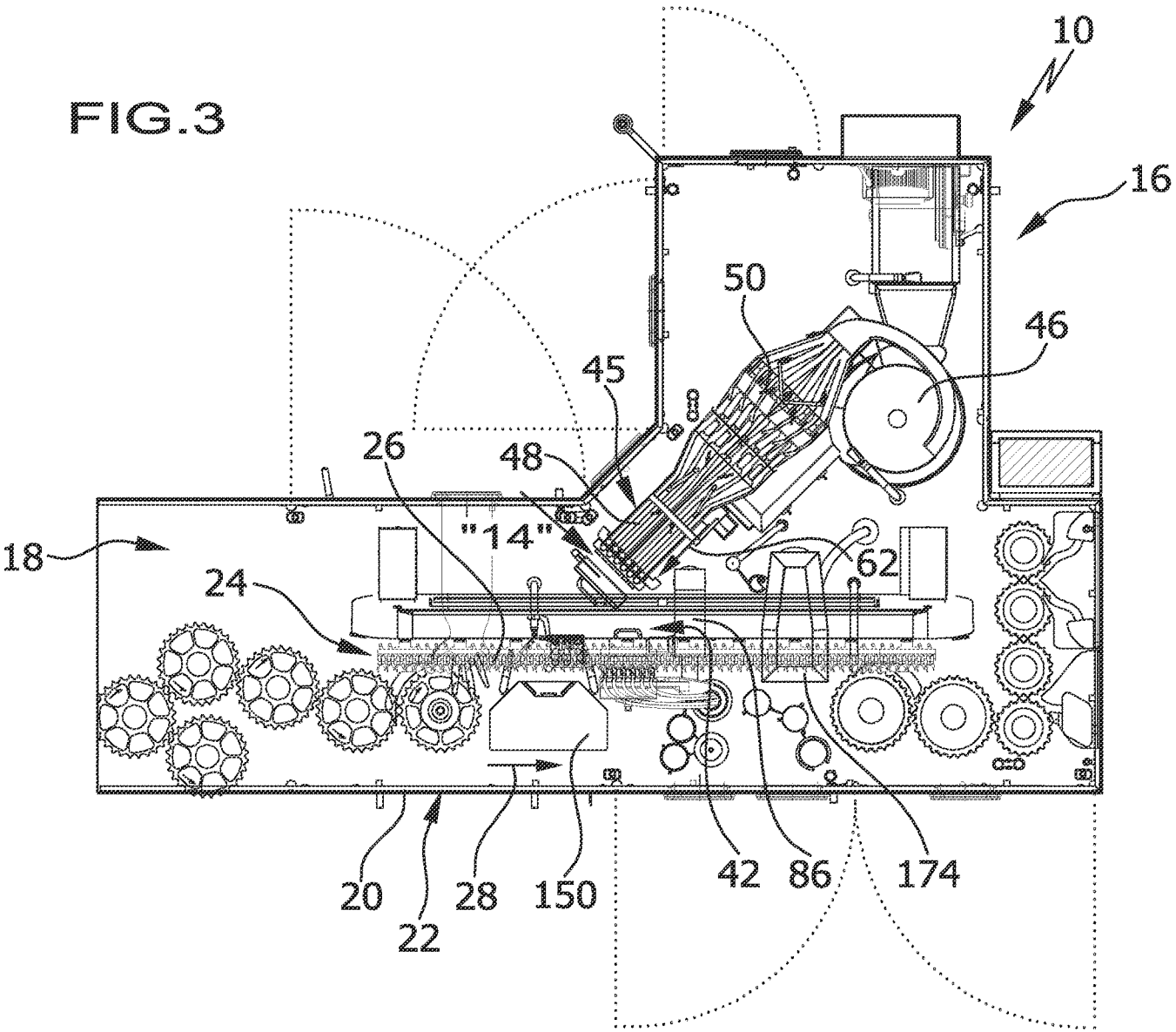
FIG. 3 is an enlarged detail view of section B in FIG. 1.

Although the present disclosure is illustrated and described herein with reference to specific embodiments, the present disclosure is not intended to be limited to the details shown. Rather, various modifications may be made in the details within the scope and range of equivalents and without departing from the present disclosure.

The present disclosure relates to a closing apparatus for closing pharmaceutical containers with closure elements, wherein the closure elements comprise a first face and a second face and, when the container is closed with the closure element, the first face faces a container interior and the second face faces away from the container interior, the closing apparatus comprising:

a feed unit with a feed path in which closure elements are feedable separately and at least partly and preferably completely without contacting the first face, a receiving body with a receptacle for the closure element, wherein the closure element is transferrable from the feed path into a receiving position in the receptacle, and a turning device for turning the receiving body from an initial position into an end position and transferring the closure element from the receiving position into a placed position in which the closure element is positioned on the container or at a distance from the container such that the first face points in the direction of the container interior.

The closure element used for closing the container has a first face. When the container is closed, the first face faces in the direction of the container interior and is arranged, for example, inside a container opening. The first face faces the substance filled into the container. The second face of the closure element faces away from the container interior and in particular faces in the direction of the outside of the container away from the pharmaceutical substance. In the feed path, the separately feedable closure elements are arranged such that the first face is at least partly and preferably completely free of contact with the feed path, even more preferably free of contact with additional components of the closing apparatus. In particular, the first face can be exposed within a protective and/or decontaminating atmosphere such that a protective gas, for example $H_2O_2$, can be applied to it. Any foreign particles and/or contaminants are removed by means of the protective gas. The first face can be disinfected, for example. By means of the turning device and the receiving body, the received closure element can be turned and transferred into a placed position on or at a distance from the container. In the placed position, the first face faces toward the container interior. Subsequently, the container can be closed by means of the closure element. For this purpose, a pressing device can be provided, for example, which is discussed below. The possibility of applying the protective gas to the closure element on the first face can increase the operational reliability of the apparatus compared to a conventional closing apparatus.

In the closing apparatus according to the present disclosure, it is preferably provided that within a protected environment provided with the protective and/or decontaminating atmosphere, the closure elements can be arranged on the containers without a vacuum device and corresponding gripping element, so to speak in a "vacuum-free" manner. The requirements for any filter elements and/or recirculations for protective gas can thus be reduced.

It is understood that the closing apparatus and the system for processing containers can in particular comprise a control device. The control device preferably controls all processes of the closing apparatus and of the system.

In relation to the direction of gravity, the first face in the feed path and/or in the receiving position preferably faces upward, i.e., counter to the direction of gravity, and the second face faces downward, i.e., in the direction of gravity. In this way, the first face can be exposed to a protective gas flowing from top to bottom.

In relation to the direction of gravity, the second face in the placed position preferably faces upward, and the first face faces downward. After any cleaning and/or contamination and turning of the closure element, additional contamination can therefore be largely avoided before the closure element is arranged and, where appropriate, pressed on.

When the container is properly closed, the first face can be or form an underside of the closure element, and the second face can be or form the upper side thereof.

Position and/or orientation information, such as "top," "bottom," "vertical," "horizontal" or the like, relate in the present case to a proper position of use of the closing apparatus and of the system. In particular, it is provided that, for example, a setup device of the system is positioned on the floor of a hall or of a laboratory, and the closing apparatus is arranged on the upper side of the setup device. For example, a cover element of an isolator device covers the closing apparatus. In the present case, "upward" and "downward" are to be understood in particular with respect to the direction of gravity.

The closing apparatus can preferably comprise a supply of closure elements from which the closure elements can be fed to the feed path. The supply is received, for example, in a conveying pot. The closure elements are fed separately from the conveying pot to the feed path in particular such that the closure elements that have an undesired orientation, for example with the second face upward, fall back into the conveying pot. Closure elements with the correct orientation, in particular with the first face upward, are guided separately through the feed path up to the receiving body.

In the feed path, the first face of the closure element is preferably directed upward, wherein the feed path is in particular free at the top. As a result, a protective gas can reach the first face particularly well. Any contact between the closure element and components of the closing apparatus and/or of the system which could lead to contamination can preferably be avoided.

In the feed path, the second face of the closure element preferably rests on a base of the feed path.

In the placed position, the closure element is advantageously arranged on the upper side of the container or above the container. In particular, the closure element can be arranged in a straight line above the container along the direction of gravity. In this case, the closure element can be lowered by a linear displacement in the direction of the container.

The closure elements are fed horizontally, for example, in the feed path.

It may be provided that the receiving body, in the initial position for receiving the closure element into the receiving position, contacts the feed path and/or is arranged above the feed path.

It is favorable if the closing apparatus comprises an insertion element via which the closure element arranged at one end of the feed path can be inserted into the receptacle when the receiving body is in the initial position. In particular, it is advantageous if the second face of the closure element can be acted upon via the insertion element by an insertion force in the direction of the receptacle. The first face can be free of contact with the insertion element. In a preferred embodiment, the insertion element can push the closure element upward into the receptacle. The insertion element can be or form a pressing-in element for pressing the closure element into the receptacle so that the closure element is reliably held on the receiving body, for example by positive engagement.

A blocking device can be arranged on the feed path, by which blocking device subsequent closure elements can be blocked in the feed path when a closure element is inserted from the feed path into the receptacle. For example, the blocking device comprises a blocking element that can be inserted transversely into the feed path and blocks it.

The closure element is preferably held in the receptacle by means of a force fit and/or a positive engagement. The receiving body is preferably dimensioned such that it is adapted to the contour of the closure element which is received, for example, in a press fit. For example, the receiving body can be a format part for the respective closure elements.

An outer edge of the closure element preferably rests at least in sections on an edge of the receptacle.

The receptacle can comprise, for example, an insertion opening and an outlet opening opposite thereto for the closure element, wherein the closure element can be moved through the insertion opening into the receptacle and through the outlet opening out of the receptacle. For example, the closure element is moved via the insertion opening into the receptacle by means of the aforementioned insertion element. By means of a corresponding pushing element, the closure element can, for example, be moved out of the receptacle via the outlet opening.

The receptacle can be designed, for example, as an aperture in the receiving body, wherein the closure element, when in the receiving position, rests against an edge of the aperture.

The receptacle may, for example, be sleeve-shaped and comprise a lateral aperture. The lateral aperture forms a free space which allows the receiving body to be moved past other components of the closing apparatus, for example as explained below. When the receiving body is in the initial position, the aperture is preferably directed in the direction of the feed path.

In a preferred embodiment of the present disclosure, the receiving body comprises, for example, a suction line with a suction opening arranged on an edge of the receptacle, and the closing apparatus comprises a vacuum device for applying a negative pressure to the suction line, wherein the closure element is held in the receptacle by means of a negative pressure. A receptacle of this form is used, for example, for placing crimp caps on containers already closed by means of closure elements. In the present case, "closing" the containers can accordingly be understood to mean that, in addition to the closure element, an additional closure element can be arranged. If, in the present embodiment, the containers have already been closed with closure elements, for example within an environment provided with protective gas, additional closure elements, in particular crimp caps, can be held on the receiving body, for example by means of the vacuum device. In this case, the use of a negative pressure ("vacuum positioning") by the closure elements can prove to be unproblematic in that the containers are already closed, and contamination of the container interior can no longer occur. Such an apparatus can be used, for example, outside an environment with a protective and/or decontaminating atmosphere.

In a preferred embodiment of the present disclosure, the turning device is a pivot device or comprises such a pivot device, by means of which the receiving body can be pivoted about a pivot axis for transferring from the initial position into the end position. The pivot axis is preferably oriented horizontally. The closure elements can be pivoted from the respective receiving position into the respective placed position by the pivot device.

In one embodiment of the present disclosure in which the receiving body comprises a plurality of receptacles arranged in a row, it may be provided that the pivot axis is oriented in parallel to the receptacles. Alternatively, it may be provided that the pivot axis extends through the receptacles.

The pivot angle for pivoting from the initial position into the end position is preferably greater than 90°, even more preferably greater than 135°. In a preferred embodiment of the present disclosure, the pivot angle is 180° or substantially 180°. As a result, the closure elements can in particular be turned completely by means of the pivot device, wherein the first face preferably points upward in the initial position and downward in the placed position.

A height of the closure element, in particular along the direction of gravity, can preferably be the same or substantially the same in the receiving position and in the placed position. In the initial position and in the end position, the receiving body can have the same height in the direction of gravity.

The turning device preferably does not have a linear stroke movement for transferring the receiving body from the initial position into the final position, which simplifies the operation of the closing apparatus. In particular, only a pivoting movement for turning the closure elements can be provided.

It may be favorable if the turning device is or comprises a lifting device for raising or lowering the receiving body. The lifting device permits, for example, an adaptation of the closing apparatus to containers of different sizes. The containers differ in height, for example. The closing apparatus can be adapted in many ways by means of a stroke movement, set once during a format change to the higher or lower containers.

The feed path can define, for example, a feed direction for the closure elements, and a transport device can be provided for the containers which can be transported with the transport device in a transport direction to the closing apparatus, wherein an angle between the feed direction and the transport direction is less than 90°, preferably less than 70°, preferably approximately 40° to 60°. It has been shown in practice that a relatively compact design of the system for processing containers with the closing apparatus can be achieved in this way. Over the length of the feed path, the separate closure elements can preferably be exposed to protective gas in order to ensure a high level of process safety. At an angle of approximately 40° to 60°, a setup device for the system can, for example, be substantially L-shaped in plan view, wherein the transport device is arranged along a leg of the L, and the closing apparatus is arranged substantially in the region of the intersection of the two legs of the L.

It is favorable if the turning device comprises or forms a pivot device for pivoting the receiving body about a pivot axis and transferring the receiving body from a position remote from the container to a position close to the container, in which position a distance of the receiving body from the container is less than in the position remote from the container. Here, the pivot axis can in particular be oriented vertically.

It is expedient if the receiving body can be transferred from the initial position into the end position while the turning device is pivoted from the position remote from the container into the position close to the container. Because it is possible to pivot simultaneously and/or synchronously, cycle times of the closing apparatus can be kept low.

The pivot angle for pivoting from the position remote from the container into the position close to the container is preferably less than 90°, preferably less than 70°, and preferably approximately 40° to 60°. In particular, the pivot angle can substantially correspond to the angle between the feed direction and the transport direction.

The closing apparatus preferably comprises a pressing device for pressing the closure element onto the container or for pressing the closure element into a container opening. In this way, a reliable seat of the closure element on the container can be ensured. The pressing device can have at least one pressing element.

The closing apparatus preferably comprises a supporting body for supporting the container with a force directed counter to a pressing force of a pressing device. In this case, the container can, for example, stand on the supporting body at least during the pressing of the closure element.

In a preferred embodiment of the present disclosure, the closure element can rest against a container opening in the placed position. Accordingly, it may be provided that the receiving body moves the closure element directly to the container opening. The closing apparatus can comprise a pressing device with a pressing element that presses the closure element into the container opening or presses it onto the container and acts on the second face with a pressing force. In this embodiment, the container can still be unclosed or can already be closed by means of a closure element.

The pressing element can, for example, be a pivot element or a pushing element that can be pivoted or pushed toward the second face and brought into contact with the second face. It is understood that a drive in this regard is provided for the pressing element.

It may be provided that the closing apparatus comprises a gripping element for gripping the closure element assuming the placed position, a vacuum device by which a negative pressure can be applied to the gripping element for removing the closure element from the receptacle of the receiving body, and an adjusting device for moving the closure element with the gripping element to the container, wherein the closure element can be placed on the container when the negative pressure is not applied. Such a device is used, for example, for placing a closure element outside an environment with a protective and/or decontaminating atmosphere. Accordingly, for example, crimp caps can be gripped by means of the gripping element and placed onto an already present closure element on the container.

The adjusting device is preferably a displacement device for in particular linear displacement of the gripping element. The displacement device can advantageously be a lifting device in which the closure element is lowered by means of the gripping element from above onto the container or the already arranged closure element.

The closure element can preferably be gripped on the second face by means of the gripping element, wherein the first face is preferably not in contact with the gripping element.

In a preferred embodiment of the present disclosure, it is provided that the closing apparatus comprises a holding body and that an insertion element is provided, wherein the closure element can, by means of the insertion element, be pushed out of the receptacle of the receiving body in the end position thereof into a corresponding receptacle of the holding body. In this way, the closure element can be transferred to the holding body and, for example, be subsequently arranged on the container by said holding body.

Preferably, the second face of the closure element can be subjected to the insertion force in the direction of the receptacle of the holding body by means of the insertion element.

The receptacles of the receiving body and of the holding body can advantageously be formed to be congruent with one another.

The insertion element can be designed as a pressing-in element by which the closure element can be pressed from the receptacle of the receiving body into the receptacle of the holding body.

Preferably, the closure element is moved through the aforementioned outlet opening out of the receptacle of the receiving body.

The receptacles of the receiving body and of the holding body can preferably be designed to correspond to one another.

For example, the closure element is held in the receptacle of the holding body by means of a force fit and/or positive engagement. The receptacle can be adapted to the contour of the closure element, which is received, for example, in a press fit. The holding body can in particular be a format part adapted to the closure elements.

An outer edge of the closure element preferably rests at least in sections on an edge of the receptacle of the holding body.

The receptacle of the holding body preferably comprises an insertion opening and an outlet opening opposite thereto for the closure element. The closure element can be movable, for example, through the insertion opening into the receptacle and through the outlet opening out of the receptacle. The receptacle can be formed, for example, in the form of an aperture in the holding body.

For example, the receptacle is sleeve-shaped and comprises a lateral aperture.

In a preferred embodiment, it may be provided that the holding body is or comprises at least one tube or a sleeve and is preferably dimensioned such that the tube or the sleeve can be inserted into the container without contacting an edge of a container opening. In this way, for example, plunger stoppers can be placed by inserting the tube or the sleeve into the container opening. Any contamination can be avoided in that the tube or sleeve is free from contact with the edge of the container opening. For example, as explained below, the closure element is removed from the tube or the sleeve with a hold-down device.

The insertion element is preferably designed as a plunger.

After insertion of the closure element into the holding body, the receiving body can preferably be transferred again from the end position into the initial position. It has proven advantageous, for example, if the receptacle of the receiving body comprises a lateral aperture. In preferred embodiments, for example, the receiving body can be pivoted away from the insertion element by moving the insertion element through the aperture.

The closing apparatus advantageously comprises at least one adjusting device for moving the holding body, which receives the closure element, and/or the insertion element in the direction of a container opening of the container. It may be provided that a separate adjusting device is assigned in each case to the holding body and the insertion element. A simultaneous and/or synchronous displacement can take place by means of a control device, for example. Alternatively, the holding body and the insertion element can be moved separately.

The at least one adjusting device is preferably a displacement device for in particular linear displacement of the holding body and/or of the insertion element in the direction of the container. The displacement device can advantageously be a lifting device.

The holding body and the insertion element can preferably be displaced synchronously in the direction of the container, wherein the insertion element preferably rests against the closure element during the displacement.

In a preferred embodiment of the present disclosure, the closure element can be placed against an edge of the container opening by means of the holding body, and the closure element can be pressed by means of the insertion element out of the receptacle of the holding body into the container opening for closing the container. In this case, the insertion element can act as a pressing element for the closure element. Accordingly, the closing apparatus can comprise a pressing device. Favorably, the container is supported by means of the aforementioned supporting body while the closure element is pressed on.

The holding body and the insertion element can advantageously be removed from the container by means of the at least one adjusting device, for example after the container has been closed. It may be provided here that the holding body can be removed from the container before the insertion element is displaced.

Accordingly, it may be provided that the closure element is pressed into the container opening by means of the insertion element, wherein the holding body is initially arranged in a stationary manner relative to the container. Subsequently, the holding body can be removed from the container by the adjusting device, and the insertion element can thereafter be removed from the container by the adjusting device.

In a preferred embodiment of the present disclosure, the holding body with the received closure element engages in the container opening, wherein the insertion element forms a hold-down device for applying a retaining force to the closure element, wherein the holding body can meanwhile be removed from the container by means of the at least one adjusting device so that the closure element can be displaced out of the receptacle to remain in the container opening. Such a configuration is used, for example, for arranging plunger stoppers. The holding body, which is, for example, tubular or sleeve-shaped, engages in the container opening. The insertion element acts on the closure element. At the same time, the holding body is removed. In this way, a pressing force on the container can be avoided, which is otherwise used, for example, for arranging mushroom plugs.

As already mentioned, the closure elements may be mushroom plugs, plunger stoppers, crimp-stopper caps, or crimp caps. In particular, it may be provided that the crimp caps are placed onto already arranged mushroom plugs.

The closing apparatus preferably comprises at least one monitoring device with which the closure element can be checked for its presence and/or correct seat on the container. The monitoring device is, for example, optical. If the closure element is missing, it may be provided, for example, that the container is moved back to the closing apparatus by means of a transport device in order to provide a closure element. Alternatively, the container can be discharged by means of the transport device when the closure element is missing. If the seat of the closure element is incorrect, the container can be discharged via the transport device, for example.

It may alternatively or additionally be provided that a monitoring device can check whether a closure element has been received in at least one receptacle (preferably in all receptacles) of the receiving body, wherein, for example, the receptacle can be predetermined or predeterminable, or alternatively can be any receptacle. Monitoring preferably already takes place before and/or during the turning of the receiving body, but favorably before the closure elements are lowered onto the containers. If a closure element is missing, the corresponding receptacle can preferably be filled or refilled by the missing closure element. For example, the aforementioned insertion element can be selectively actuated for the closure element.

Additional insertion elements, provided that several closure elements can be processed at the same time as mentioned below, are not actuated in this case, for example if the corresponding receptacle on the receiving body is already filled with a closure element. For monitoring, an optical monitoring device (e.g., with optical fibers) can, for example, be used, past which the receiving body pivots.

It is therefore advantageous if individual closure elements can be added to the receiving body as required.

It is also conceivable that only one or more receptacle(s) is/are selectively filled with a respective closure element, for example by actuating the respective insertion element. At least one receptacle of the receiving body can remain empty.

It is particularly preferred for the closing apparatus to be configured to simultaneously close a plurality of containers with a respective closure element. Although not explained in detail above, it may be provided for a plurality of feed paths, a plurality of receptacles in the receiving body, a plurality of insertion elements, a plurality of receptacles in the holding body, a plurality of pressing elements, etc., to be provided. By simultaneously closing a plurality of containers, the cycle time of the closing apparatus can be reduced. In particular, the respective components of the closing apparatus for processing a plurality of closure elements are configured identically.

The above embodiments show that the present disclosure can have in particular the following properties and/or advantages:

a uniform feeding and/or placing technique for different types of closure elements, for example mushroom plugs, plunger stoppers and crimp caps;

the possibility of adding a missing closure element, even individually;

the possibility of using a vacuum-free technique for closure elements, for example in a filling machine;

the possibility of applying protective gas to the closure elements on the face touching the product.

A system in accordance with the present disclosure for processing pharmaceutical containers, for example vials, syringes or carpules, which achieves the object mentioned at the outset, comprises a transport device for transporting the containers along at least one transport direction, a filling station arranged on the transport device for filling a pharmaceutical substance into the containers, and a closing apparatus of the type described above, downstream of the filling station in the transport direction, for closing the containers after filling.

The advantages that can be achieved with the closing apparatus in accordance with the present disclosure have already been explained and can also be achieved with the system according to the present disclosure. Reference is made to the above statements.

Advantageous embodiments of the system in accordance with the present disclosure result from advantageous embodiments of the closing apparatus in accordance with the present disclosure. In this regard too, reference is made to the above statements.

In particular, closure elements in the form of mushroom plugs, plunger stoppers, crimp caps or crimp-stopper caps are arranged with the system in accordance with the present disclosure.

The transport device can have a plurality of components, including in particular a linear transport system for the linear transport of the containers.

Preferably, the containers are closed as soon as possible after being filled with the substance, where appropriate after a filling check by means of a weighing station.

It is favorable for the system to comprise a setup device on which the closing apparatus for closing the containers and the transport device are arranged, and an isolator device which has a cover element and covers the closing apparatus and the transport device, preferably for providing a protective and/or decontaminating atmosphere between the cover element and the setup device and for applying the protective atmosphere to the first faces of the closure elements. The protective and/or decontaminating atmosphere comprises in particular a protective gas, for example $H_2O_2$. The preferably upward directed first faces of the closure elements can be exposed to the protective gas.

In a preferred embodiment, the system can comprise an additional closing apparatus for closing the containers, which is downstream of the first mentioned closing apparatus in the transport direction, for additionally closing containers, closed in particular by mushroom plugs, by means of closure elements in the form of crimp caps. The mushroom plugs are in particular arranged by means of the first closing apparatus, and the crimp caps are arranged by means of the second closing apparatus. The system may comprise a crimping station, arranged downstream in the transport direction, for crimping the crimp caps.

In a preferred embodiment of the present disclosure, the system comprises, at the transport device, an additional closing apparatus for closing the containers and a turning station which are arranged upstream of the filling station in the transport direction, wherein a first container opening can be closed by means of a closure element of the additional closing apparatus, after which the containers are turned by means of the turning station and subsequently filled by means of the filling station. Such an embodiment is used, for example, for closing carpules on both sides.

Upstream of the filling station, the carpule can be closed at the container opening and then turned. After filling, the carpule is closed at the other container opening.

The possibility of using format parts has already been discussed. The components of the closing apparatus and/or of the system are preferably each designed such that they can cover a plurality of different formats. In this context, "format" is understood in particular to mean containers of different types which differ from one another with regard to their container type (vials, syringes or carpules) and/or with regard to their container properties (such as in particular size). In this way, the present disclosure proves to be very versatile.

The closing apparatus and/or the system can preferably have a plurality of format sets with respective format parts. Depending on the respective need, the most suitable format parts can be selected in each case. The closing apparatus and/or the system can be adapted in this way to the intended use in a versatile manner.

Preferred embodiments of the system in accordance with the present disclosure for processing pharmaceutical containers and preferred embodiments of the closing apparatus in accordance with the present disclosure for closing the containers with closure elements are described below. Identical reference numerals are used for identical or identically acting features and components, wherein a first system in accordance with the present disclosure and a first closing apparatus in accordance with the present disclosure are initially discussed. The explanations in this regard also in each case apply to the various embodiments so that only the essential differences are explained below.

FIG. 1 shows in a schematic plan view an overview of a system in accordance with the present disclosure, designated by reference numeral 10, for processing pharmaceutical containers 12 which are shown schematically in FIG. 1A. The containers may, for example, be vials, syringes or carpules. First, the present disclosure is explained using the example of containers 12 to be closed in the form of vials.

The system 10 comprises a first portion 14 shown in a detail view in FIG. 2 and a second portion 16 shown in a detail view in FIG. 3.

In the plan view of portions 14 and 16, a setup device 18 of the portions 14, 16 is shown in each case. The setup device 18 is, for example, a frame or a substructure which is positioned on a floor of a hall or of a laboratory. A clean-room environment may be advantageous.

Position and orientation information is, as explained, related to an intended and proper use of the system 10.

The system 10 comprises in each case an isolator device 22 covering the setup device 18 with a cover element 20. An environment which is covered by the cover element 20 and is delimited on the underside by the setup device 18 can be exposed to a protective and/or decontaminating atmosphere by means of the isolator device 22. The protective and/or decontaminating atmosphere comprises a protective gas, for example $H_2O_2$.

The cover element 20 can preferably extend with side walls up to the setup device.

For example, a flow of the protective gas from top to bottom is provided by the isolator device 22 in order to expose the components of the system 10 arranged in the environment to the protective gas. As a result of the flow from top to bottom, the exposure can take place in particular from above.

The system 10 comprises a transport device 24 with a linear transport system 26. Supplied containers 12 can be transported in a transport direction 28 along the transport system 26. Arranged on the transport system 26 is a filling station 30 with which the containers 12 are filled with a pharmaceutical substance, for example a liquid.

An advantageous embodiment of the closing apparatus in accordance with the present disclosure, designated as a whole by reference numeral 32, is arranged downstream of the filling station 30 in the transport direction 28.

In order to close the containers 12, closure elements 34 are used in the closing apparatus 32 as explained below, in the present example mushroom plugs 36, for engaging in a container opening and being placed on an edge of the containers 12.

The closed containers 12 are transferred via components of the transport device 24 in the form of transport wheels 38 from the first portion 14 to the second portion 16. The second portion 16 also comprises a transport system 26 in which the now closed containers 12 can be transported along a transport direction 28.

An advantageous embodiment of the closing apparatus in accordance with the present disclosure, designated as a whole by reference numeral 42, is arranged on the transport system 28. With the closing apparatus 42, closure elements 34 in the form of crimp caps 44 can be placed on the mushroom plugs 36 in order to completely close the containers 12.

The closing apparatus 32 is explained below with reference in particular to FIGS. 2 and 5 to 13, while the closing apparatus 42 is explained with reference in particular to FIGS. 3 and 14 to 17.

As is initially clear in particular from FIG. 2, the closing apparatus 32 comprises a feed unit 45 for closure elements 34. A conveying pot 46 is provided for storing closure elements 34. The closure elements 34 are fed to a plurality of feed paths 48 of the feed unit 45. Starting from the conveying pot 46, the feed paths 48 are filled by means of a sorting device 50.

The sorting device 50 is designed such that the closure elements 34 are guided separately and upside down into the feed paths 48. In the present case, "upside down" is to be understood in particular to mean that a first face 52 of the closure elements 34 points upward, and a second face 54 of the closure elements 34 points downward. The first face 52 is the face that faces a container interior 56 when the container 12 is closed (FIG. 1A). The second face 54 is the side that faces away from the container interior 56 when the container 12 is closed.

As also shown in FIG. 1A in a schematic representation, the container 12 has a container opening 58 which is enclosed by an edge 60. Depending on the type of container 12, the edge 60 may be designed like a flange.

Figure 4:
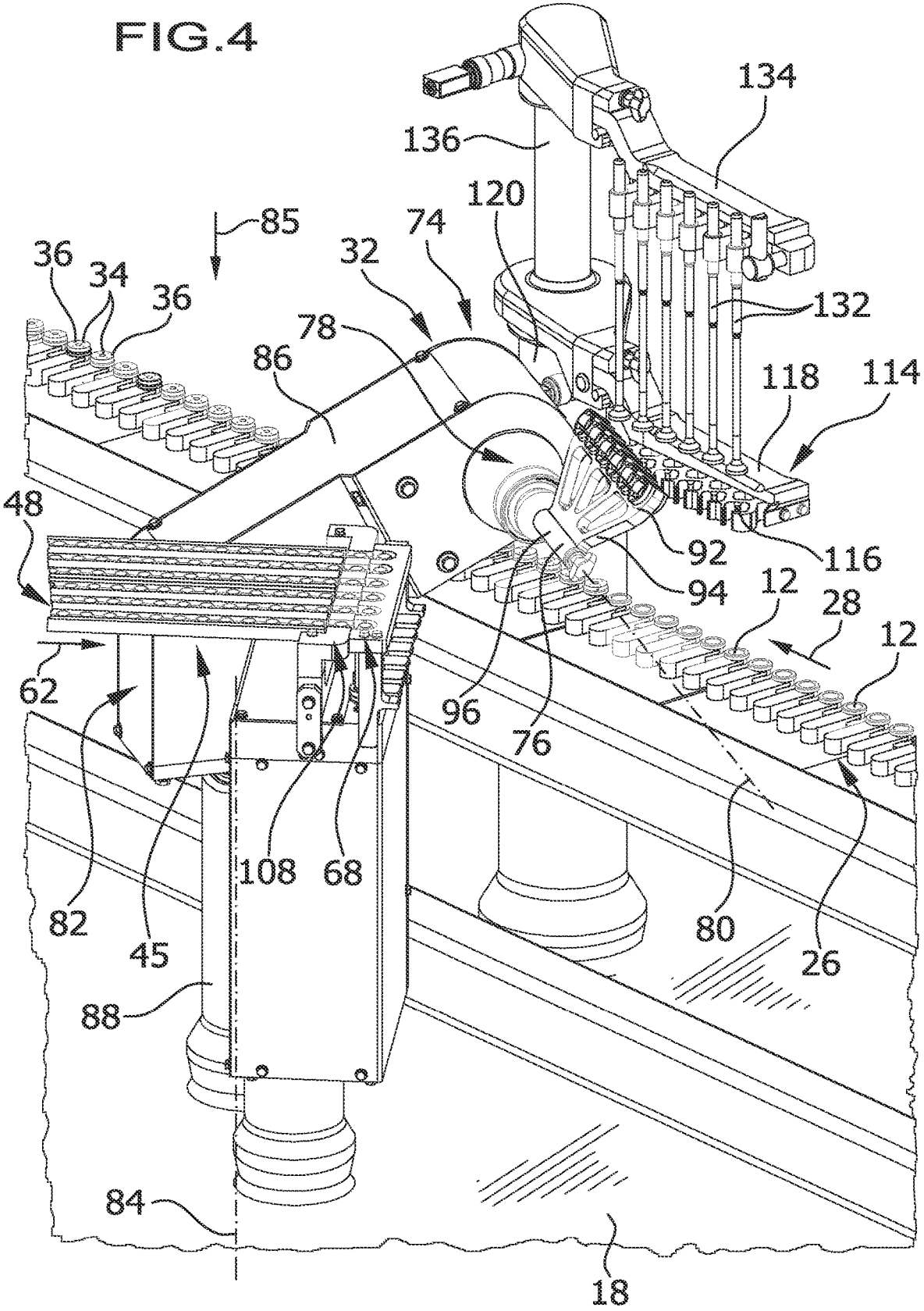
FIG. 4 is a partial representation of the system in a perspective view, seen in the viewing direction of the arrow "4" in FIG. 2, wherein a closing apparatus in accordance with the present disclosure is shown.
Figures 5, 6:
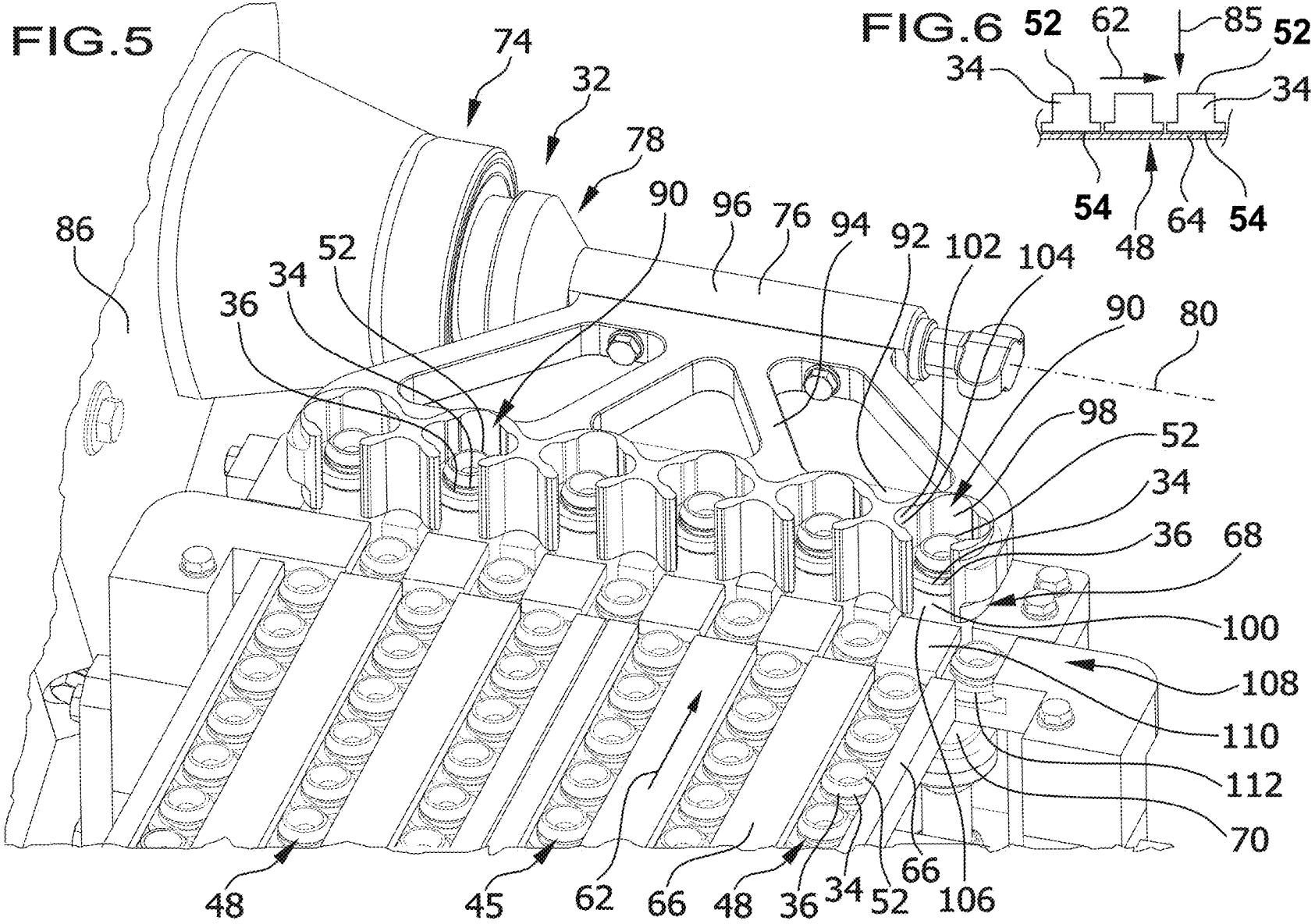
FIG. 5 is an enlarged partial representation of the closing apparatus in FIG. 4 in a perspective view.
FIG. 6 is a schematic view of a feed path and closure elements of the closing apparatus.

The sorting device 50 is designed such that closure elements 34 that, in deviation from the desired orientation in the feed paths 48, are not oriented with the first face 52 upward, i.e., are in particular oriented with the second face 54 upward, fall back into the conveying pot 46. Only those closure elements 34 whose first face 52 points upward enter the feed paths 48 (FIGS. 4 to 6).

As the figures show, the closing apparatus 32 is designed to simultaneously close a plurality of containers 12. The relevant components of the closing apparatus 32, such as feed paths 48, receptacles of the receiving body, receptacles of the holding body, and insertion elements are respectively configured identically. In order to simplify the subsequent discussion, only one of the components is in each case discussed in a representative manner. It is understood that the explanations in this regard also apply to the other components in each case.

In the present case, the feed paths 48 are aligned parallel to one another and define a feed direction 62 in which the closure elements 34 are separately fed. The feed direction 62 forms an angle with the transport direction 28. In the present case, the angle is approximately 45°. In this way, a compact design can be achieved in the system 10. The setup device 18 is substantially L-shaped in plan view. The transport system 26 extends in the transport direction 28 along a leg of the L. The closing apparatus 32 is arranged in the region of the L at which both legs cross one another.

The feed path 48 is formed in the shape of a groove and comprises a base 64 on which the closure element 34 rests with the second face 54. The closure element 34 is arranged transversely to the feed direction 62 with positive engagement between walls 66 of the feed path 48. In particular, during the transport in the feed path 48, the first face 52 of the closure element 34 does not contact the feed path 48 or other components of the closing apparatus 32 and of the system 10.

In this way, the first face 52 of the closure element 34 can be reliably exposed from above to the flow of the protective gas during the transport. Any particles can be removed, for example, by being blown off. Alternatively or in addition, contamination is removed and, for example, the closure element 34 is disinfected on the first face 52.

In the present case, the feed path 48 extends substantially horizontally and in particular in parallel to the plane of the transport system 24.

The closure elements 34 are moved via the sorting device 50 in the feed paths 48, wherein subsequent closure elements 34 each push closure elements 34 arranged in front of them.

Figure 7:
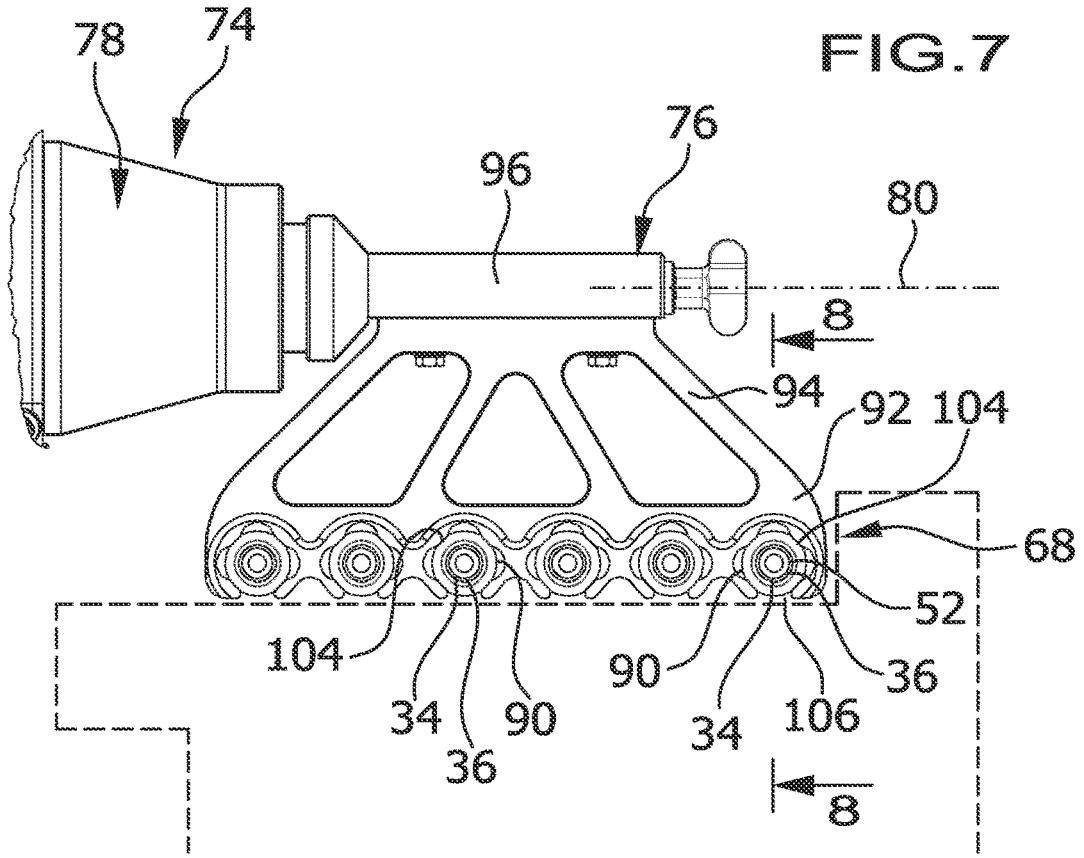
FIG. 7 is a plan view of a receiving body of the closing apparatus of FIG. 4.
Figure 8:
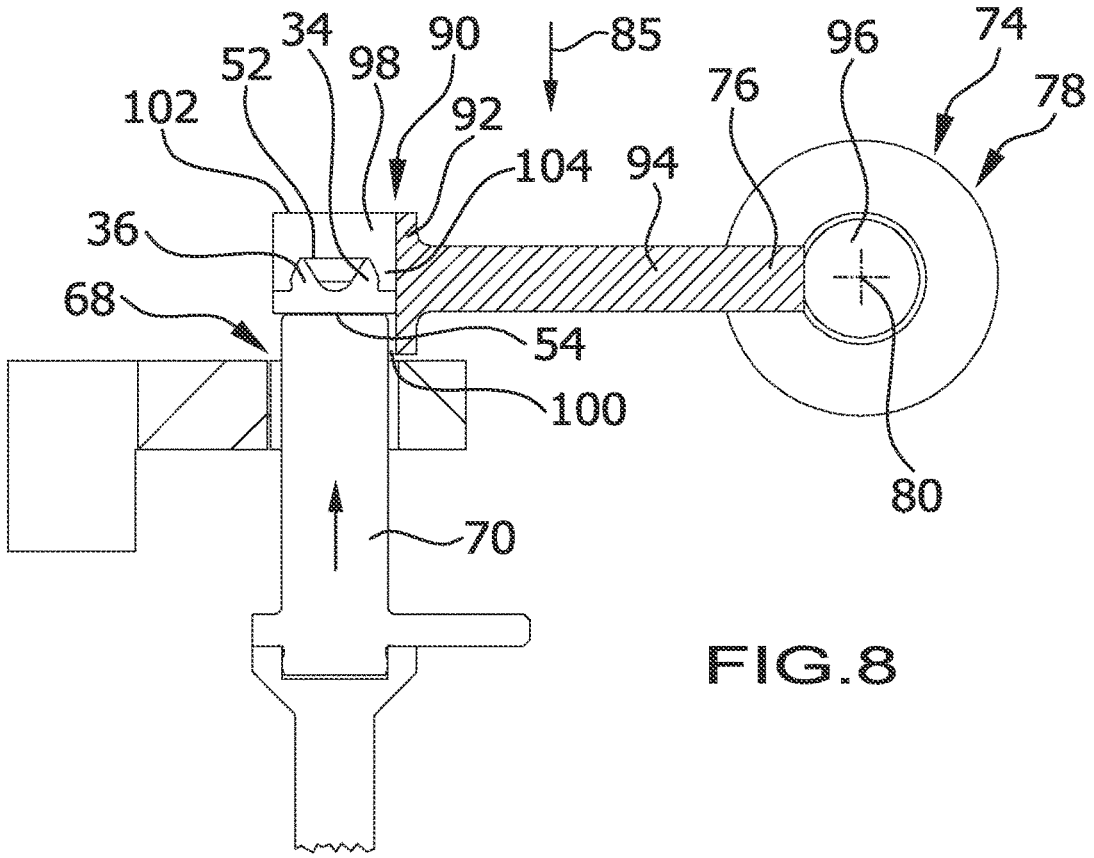
FIG. 8 is a sectional view along line 8-8 in FIG. 7.

The feed path 48 has an end 68 (FIGS. 5, 7 and 8). At the end 68, the closing apparatus 32 comprises an insertion element 70 which in the present case is designed as a pressing-in element for the closure element 34. The insertion element 70 is formed as a plunger which is arranged below the end 68 of the feed path 48. The insertion element 70 can be lifted and lowered cyclically by means of a drive.

As already mentioned, all components of the system 10 and thus the operation of the system are controlled by a control device 72.

The closing apparatus 32 comprises a turning device 74 which comprises a receiving body 76 for the closure elements 34. The turning device 74 is designed as a pivot device 78, wherein the receiving body 76 is pivotable about a pivot axis 80. In the present case, the pivot axis 80 is oriented horizontally.

The turning device 74 comprises an additional pivot device 82 for pivoting about a pivot axis 84. In the present case, the pivot axis 84 is oriented vertically. In the present case, "vertical" can be understood in particular as "along the direction of gravity." Reference numeral 85 denotes the direction of gravity.

The receiving body 76 can be pivoted about the pivot axis 78 relative to a holding part 86 of the turning device 74. The holding part 86 can in turn be pivoted about the pivot axis 84 relative to a base part 88 by means of the pivot device 82. The base part 88 is positioned on the setup device 18 and held thereon (FIG. 4).

The receiving body 76 comprises a receptacle 90 for the closure element 34. The receptacle 90 is formed on a receiving portion 92 which is connected via a connecting portion 94 to a shaft portion 96 of the receiving body 76 which is oriented in the direction of the pivot axis 80. In the present case, the plurality of receptacles 90 are formed in a row, laterally next to one another, on the receiving portion 92. The pivot axis 80 extends in parallel to the receptacles 90.

The receptacle 90 is formed as an aperture 98 in the receiving portion 92. In the region of the receptacle 90, the receiving portion 92 is substantially sleeve-shaped. In the insertion direction of the closure element 34, the receptacle 90 comprises an insertion opening 100. The insertion opening 100 is opposite an outlet opening 102.

The receptacle 90 comprises an edge 104. At an aperture 106, the edge 104 is interrupted.

The receiving body 76 can assume an initial position when pivoting about the pivot axis 78. In the initial position, the receptacle 90 is arranged above the end 68 of the feed path 48 (FIG. 8). The aperture 106 points in the direction of the feed path 48.

By means of the insertion element 70, the closure element 34 can be pushed into the receptacle 90 and in particular pressed. In this case, the receptacle 90 is dimensioned such that the closure element 34 is held in the receptacle 90 with positive engagement by the outer edge against the edge 104. In particular a press fit is formed in this case.

For insertion into the receptacle 90, the closure element 34 is subjected by the insertion element 70 to an insertion force on the second face 54. In particular, the first face 52 does not contact the receiving body 76 and can still be exposed to the protective gas from above.

Before activation of the insertion element 70, a blocking device 108 can be activated on the feed path 48 (FIG. 5). The blocking device 108 comprises a blocking member 110. The blocking member 110 can be displaced transversely to the feed path 48. Once a closure element 34 has arrived at the end 68, the blocking member 110 is moved into the feed path 48 to block other closure elements 34. The next closure element, denoted by reference numeral 112 in FIG. 5, is displaced laterally out of the feed path 48. After the receiving body 76 has pivoted, the blocking member 110 is again moved transversely to the feed path 48, and the closure element 112 reaches the end 68 under the thrust of the subsequent closure elements 34.

The receiving body 76 is pivoted with the closure element 34 from an initial position into an end position. In the present case, this involves pivoting by 180° about the pivot axis 80. The receiving body 76 is thereby turned so that the first face 52 points downward and the second face 54 upward.

Figure 9:
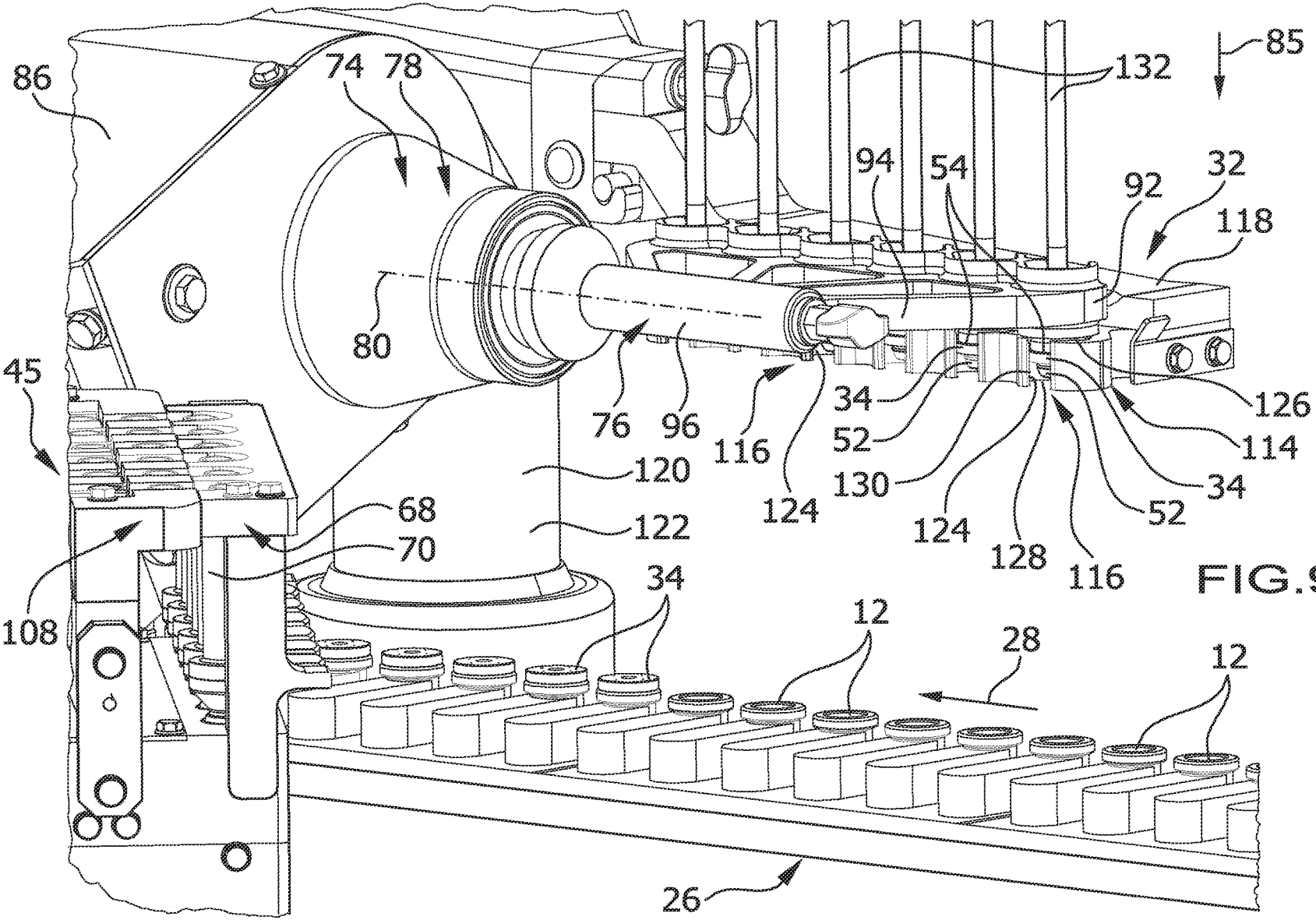
FIG. 9 is an enlarged partial representation of the closing apparatus of FIG. 8, wherein closure elements are guided by means of a receiving body on a holding body and are inserted from the receiving body into the holding body by means of insertion elements.
Figure 10:
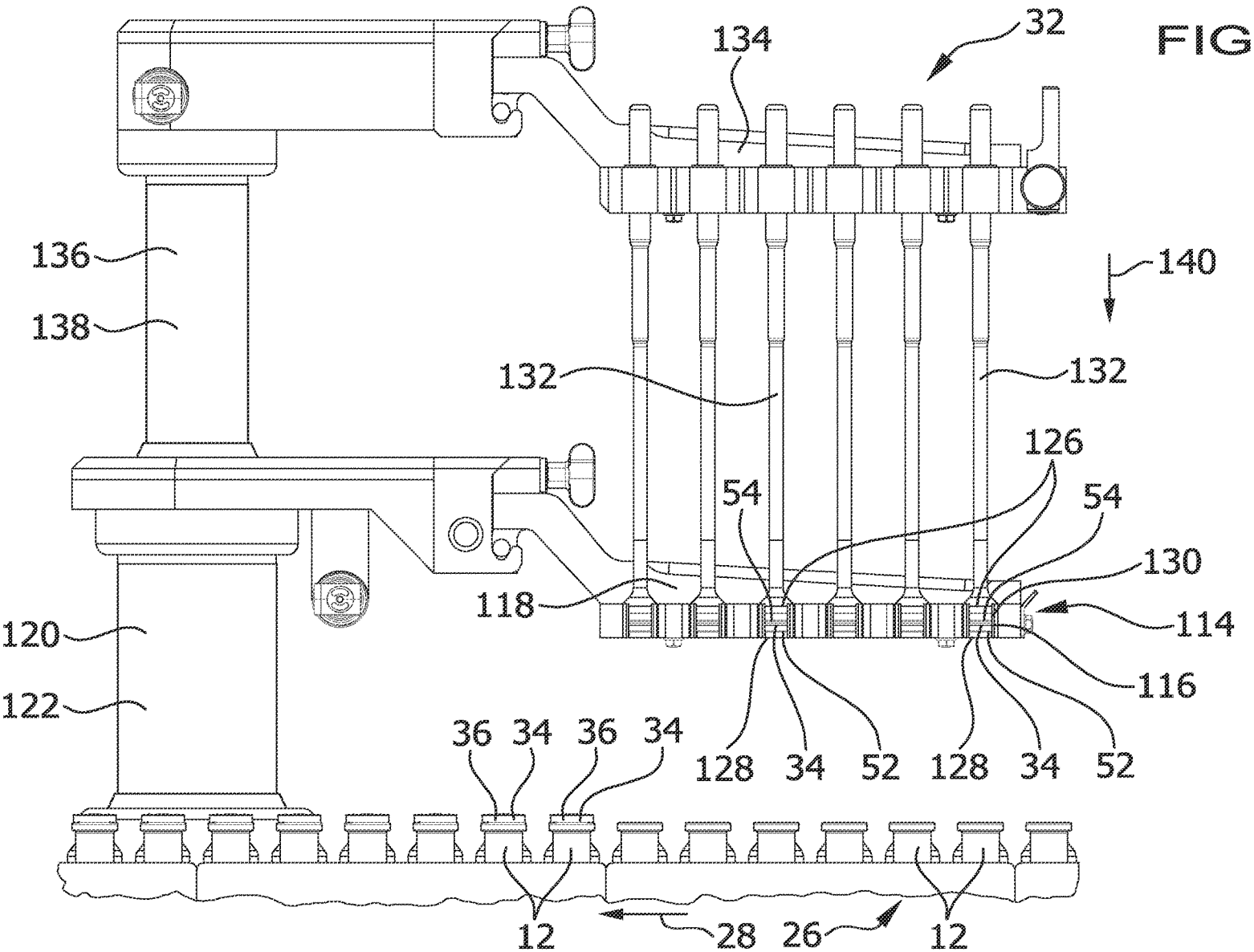
FIG. 10 is a side view of the closing apparatus before lowering the holding body and the insertion elements in the direction of containers to be closed.

In the initial position, the receiving body 76 with the closure element 34 has a position remote from the container. By pivoting about the pivot axis 84, the receiving body 76 is transferred from the position remote from the container into a position close to the container (FIGS. 4 and 9). In the position close to the container, the distance of the receiving body 76 from the containers 12 is less than in the position remote from the container.

In order to achieve a low cycle time, it is favorable if the pivoting of the receiving body 76 from the initial position into the end position is carried out simultaneously with the pivoting from the position remote from the container into the position close to the container.

When pivoting about the pivot axis 80 into the end position, there is no change in height of the receiving body 76 in the present case. In order to adapt to different formats of containers 12, it may be provided that the turning device 74 comprises a lifting device in order to change the height of the receiving body 76, for example in the case of modifications. For example, the holding part 86 can be adjusted in height relative to the base part 88.

When pivoting about the pivot axis 84 into the position close to the container, the pivot angle in the present example is substantially 45°. This pivot angle corresponds to the angle between the transport direction and the feed direction 62.

In the present case, the end position of the receiving body 76 is identical to its position close to the container. The above embodiments show that, for example, only pivoting about just one pivot axis 80 can be provided in order to turn the closure elements 34 and transfer the receiving body into the end position.

As can be seen in particular from the drawing, the first face 52 of the closure element 34 in its placed position, when the receiving body 76 assumes the end position, points in the direction of the container interior 56.

In the closing apparatus 32, the closure element 34 is arranged in the placed position at a distance from the container 12 and above the container 12. In order to close the container opening 58, the closure element 34 must be lowered. It is advantageous in this case that the closure element 34 only has to be lowered in a straight line and pushed into the container opening 58.

The closing apparatus 32 comprises a holding body 114. The holding body 114 comprises a plurality of receptacles 116 which are arranged on a common support portion 118. The support portion 118 is held on an adjusting device 120, in the present case in the form of a lifting device 122 (a displacement device). In this way, the support portion 118 can in particular be lowered and raised in a straight line.

The receptacles 116 are formed to correspond to, and preferably be congruent with, the receptacles 90. For example, the receptacle 116 comprises an aperture 124 having an insertion opening 126 and an outlet opening 128 for the closure element 34. The receptacle 116 comprises an edge 130. The receptacle 116 is dimensioned such that the closure element 34, just like in the receptacle 90, can be positively engaged therein and can be held by the outer edge at the edge 130, in particular by means of a press fit.

The closing apparatus 32 furthermore comprises an insertion element 132, by means of which the closure element 34 can be pushed out of the receptacle 90 into the receptacle 116 and in particular pressed. The insertion element 132 is accordingly a pressing element.

The insertion elements 132 are held together on a support portion 134. The support portion 134 can be displaced in a straight line and in particular in the height direction by means of an adjusting device 136, in this case configured as a lifting device 138 (a displacement device). In doing so, the insertion element 132 can be lowered in particular in the direction of the container 12 or raised again in turn.

The adjusting devices 120, 136 configured as lifting devices 122, 138 can preferably be moved independently of one another. This may be advantageous, for example, for converting the closing apparatus 32 to close different types of containers 12, as mentioned below. In particular, synchronous movement of the two lifting devices 122, 138 with one another is also possible.

Starting from the placed position when the receiving body 76 assumes the end position, the closure element 34 can be subjected to an insertion force on the second face 54 by means of the insertion element 132, which is moved with the lifting device 138. In the process, the closure element 34 is pushed out of the outlet opening 102 and via the insertion opening 126 into the receptacle 116. As a result, the closure element 34 is held on the holding body 114 (FIG. 9).

Subsequently, the receiving body 76 can be pivoted about the pivot axes 80, 84 back into the initial position and the position remote from the container. In so doing, the aperture 98 proves to be advantageous so that the receiving body 76 can be pivoted past the insertion element 132.

Subsequently, the holding body 114 and the insertion element 132 are lowered synchronously in the direction of the container 12 (arrow 140 in FIG. 10) until the closure element 34 engages in the container opening 58.

Figure 11:
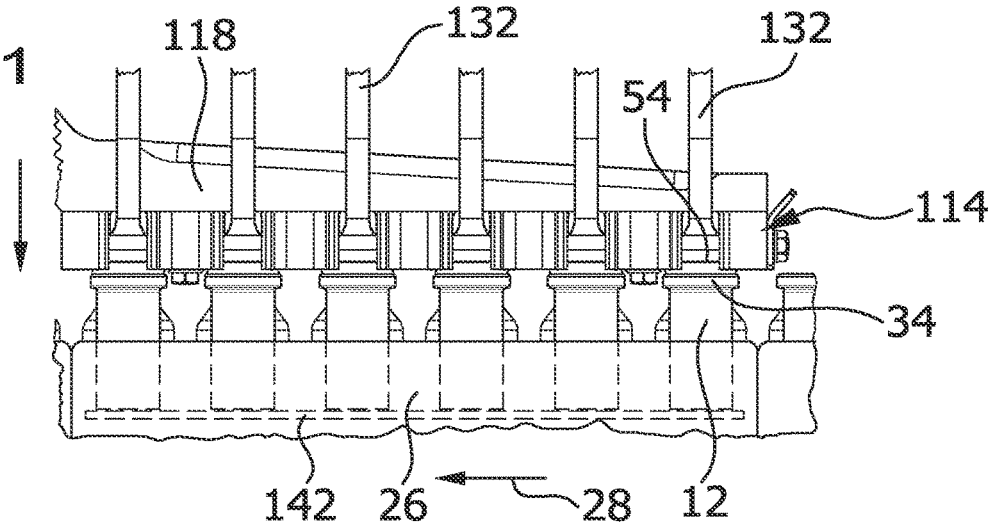
FIGS. 11 to 13 are detail views while closing the containers (FIG. 11), lifting the holding body (FIG. 12), and subsequently lifting the insertion elements (FIG. 13)

The insertion element 132 acts as a pressing element on the second face 54 and presses the closure element 34 into the container opening 58 in order to close the container 12 (FIG. 11).

The closing apparatus 32 comprises a supporting body 142 which is shown schematically in FIG. 11. The supporting body 142 applies a supporting force to the container 12, in opposition to the pressing force of the insertion member 132, in order to allow the closure element 34 to be firmly seated in the container opening 58.

Figure 12:
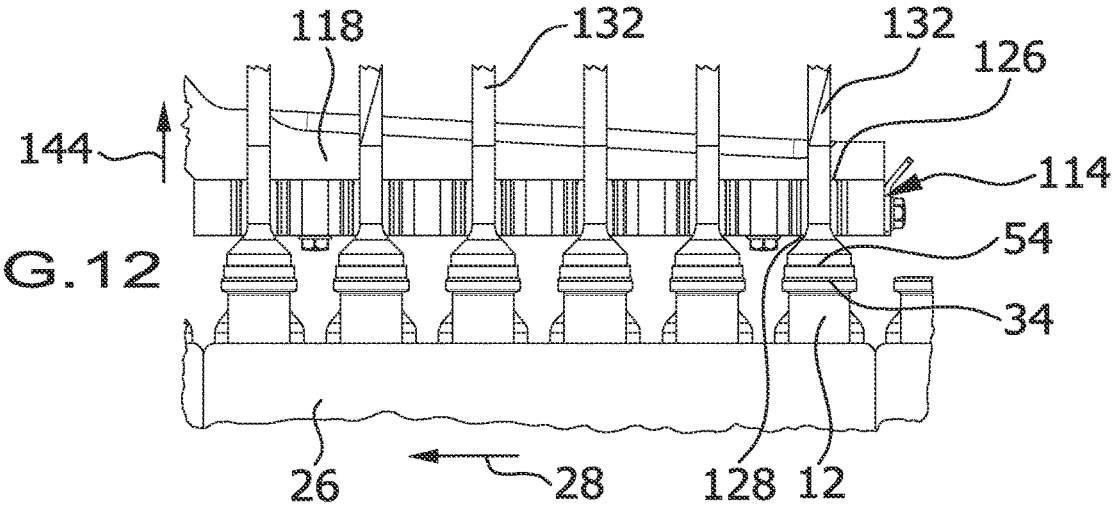
Figure 13:
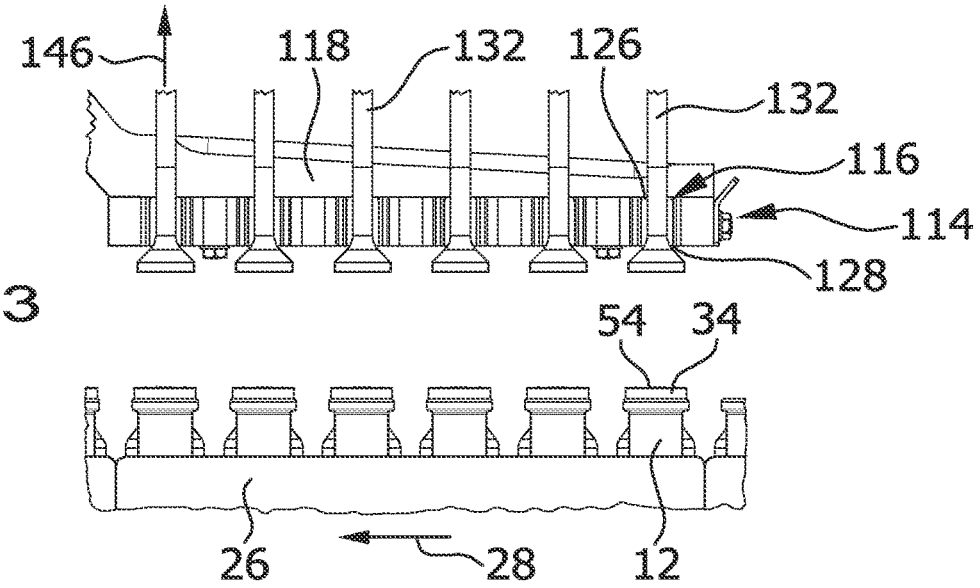

Subsequently, the holding body 114 is first lifted by means of the lifting device 122 (arrow 144 in FIG. 12). In so doing, the closure element 34 can continue to be pressed on. Subsequently, the insertion element 132 is also lifted with the lifting device 138 (arrow 146 in FIG. 13).

As already mentioned, a plurality of closure elements 34 can be processed simultaneously to close a plurality of containers 12. In the present case, six containers 12 can be closed simultaneously with a respective closure element 34.

As can be seen in particular in FIG. 2, the closing apparatus 32 comprises a monitoring device 148. The monitoring device 148 is, for example, optical and checks for the presence of a closure element 34 on a respective container 12. If the closure element 34 is missing, the transport system 26 is moved back counter to the transport direction 28, and the corresponding container 12 is closed with a closure element 34. The closure element 34 for the container 12 to be closed can be selected by the selective activation of the corresponding insertion element 70 at the end 68 of the suitable feed path 48. The other insertion elements 70 remain deactivated for this period. It is therefore possible to transfer any whole number of one to (in the present example) six closure elements 34 from the receiving position into the placed position by means of the receiving body 76.

Preferably, it may alternatively or in addition be provided that the receptacles 90 of the receiving body 76 are checked by means of a monitoring device for the presence of closure elements 34, for example optically. The monitoring takes place, for example, before or during turning or while pivoting the receiving body 76, but in particular before the closure elements 34 are lowered onto the containers.

Such a monitoring device is shown schematically in FIG. 2 and designated by reference numeral 149.

If a closure element 34 is missing in a receptacle, the movement of the receiving body 76 can wait, or it is moved back into the receiving position. The insertion element 70 corresponding to the unoccupied receptacle 90 can preferably be selectively confirmed in order to press the missing closure element 34 into the receptacle 90. In this case, the other insertion elements 70 remain unactuated.

As already mentioned, it could be provided that only one or more receptacle(s) 90 is/are selectively filled by a respective closure element 34.

As can be seen in FIG. 3, the system 10 comprises an additional monitoring device 150. The monitoring device 150 is arranged upstream of the closing apparatus 42 in the transport direction 28 on the second portion 16.

In the present example, the monitoring device 150 is also optical and serves to monitor the correct seat of the closure element 34 on the container 12. If the result of the check is negative, the corresponding container 12 is discharged from the system 10 downstream of the transport system 26.

The closing apparatus 42 with which the crimp caps 44 can be placed on the mushroom plugs 36 is discussed below with reference to FIGS. 3 and 14 to 17.

In the closing apparatus 42, the receiving body 76 comprises a main body on which the receiving portion 92 is held. The respective receptacle 90 comprises a recess 154 formed in the receiving portion 92. The contour of the recess 154 is adapted to the contour of the closure element 34. The edge 104 can thereby rest flush against an outer edge of the closure element 34.

The closing apparatus 42 comprises, in particular at the edge 104, a suction opening 156 of a suction line 158. The suction line 158 is guided through the receiving portion 92 and the main body 152. The plurality of suction lines 158 can come together in the direction of the suction flow.

The closing apparatus 42 comprises a vacuum device 160. By means of the vacuum device 160, a negative pressure is applied to the suction line 158 and thereby the suction opening 156.

If the receiving body 76 assumes the initial position, in the closing apparatus 32 according to the illustration in FIG. 5, the closure element 34 can be held in the receptacle 90 by means of a negative pressure and can assume the receiving position. The insertion can take place by means of the insertion element 70 as explained above.

Figure 14:
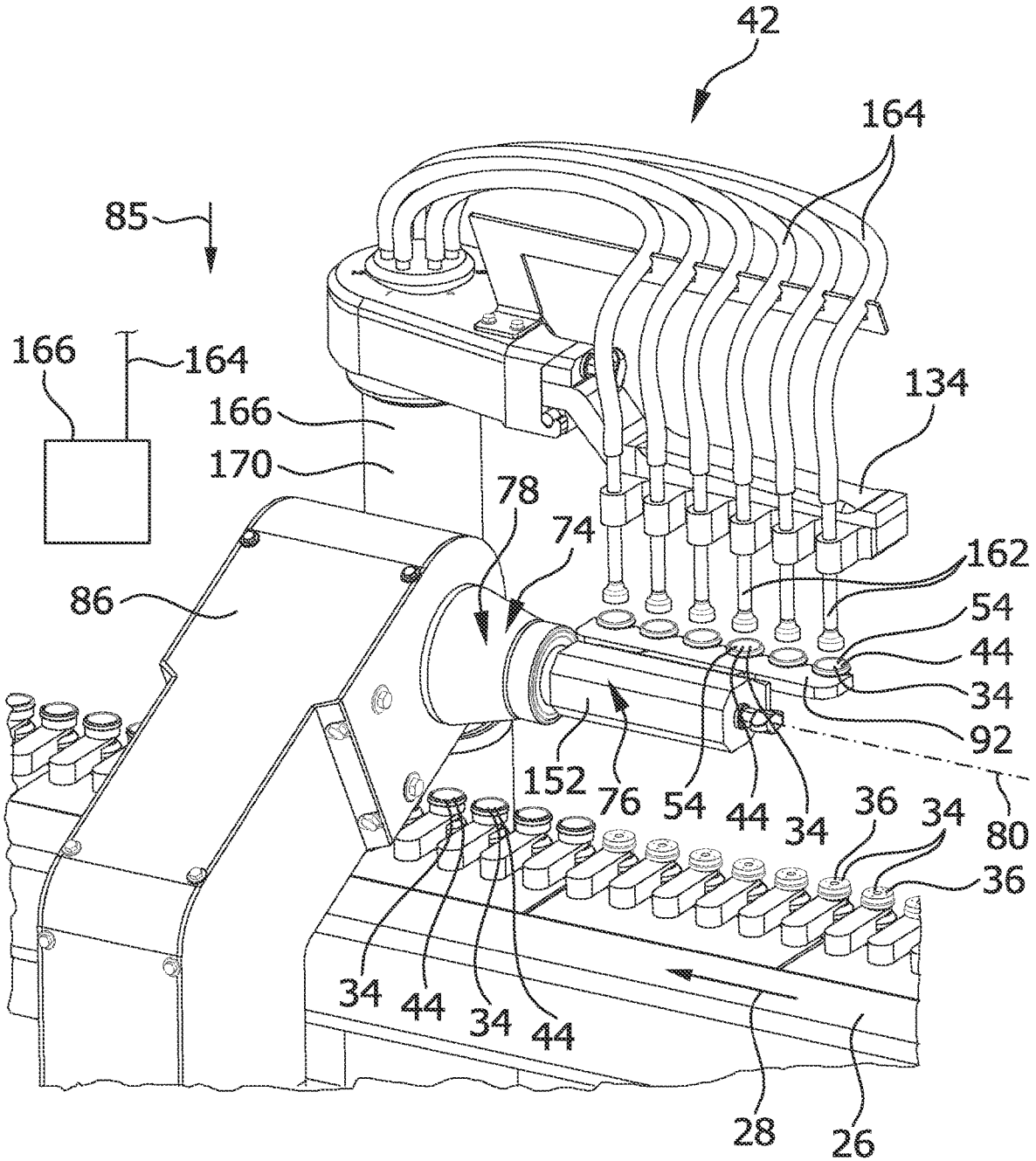
FIG. 14 is a partial representation of the system in a perspective view, seen in the viewing direction of the arrow "14" in FIG. 3, wherein a closing apparatus in accordance with the present disclosure is shown.
Figure 15:
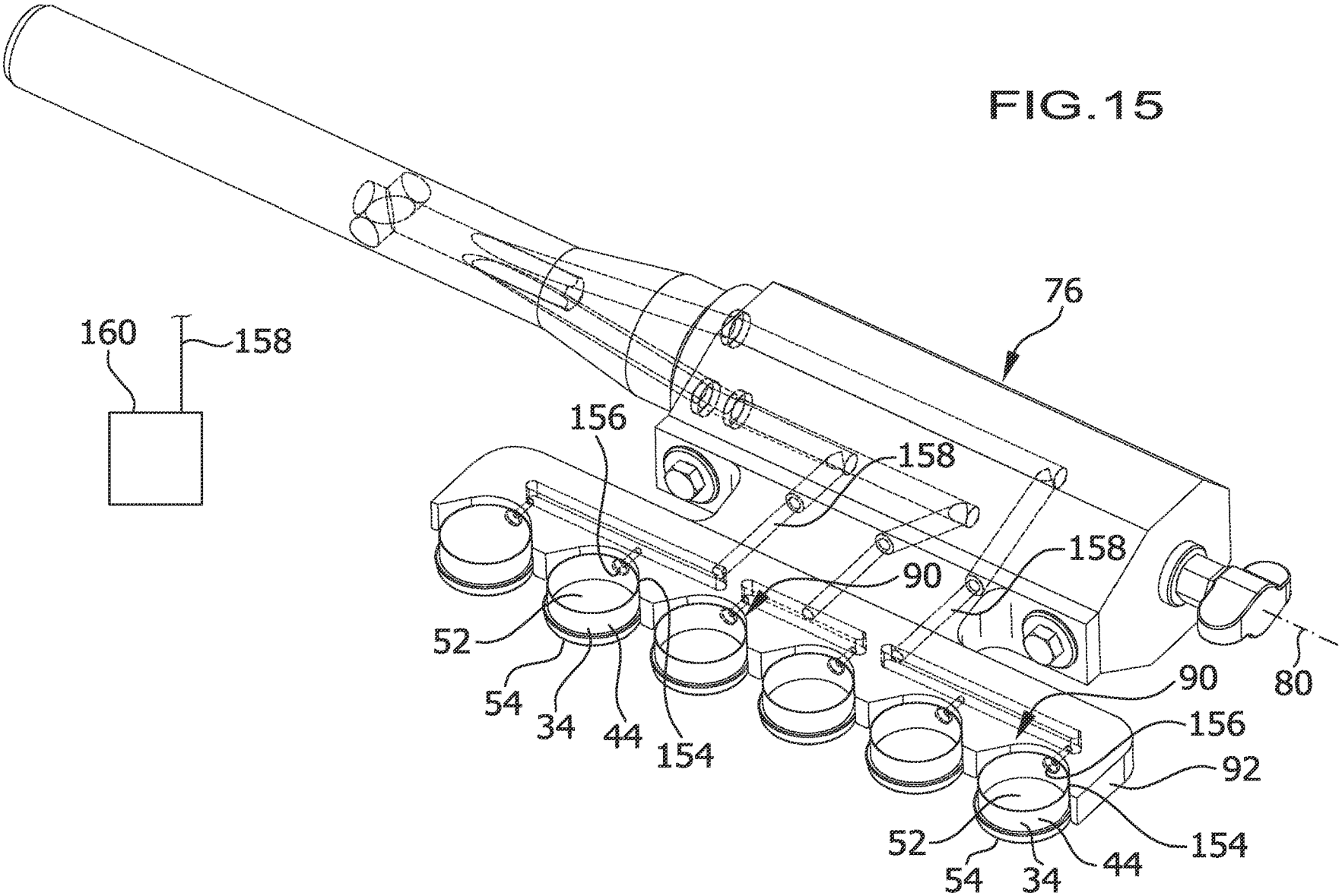
FIG. 15 is a perspective view of a receiving body of the closing apparatus of FIG. 14 and closure elements held thereon.
Figure 17:
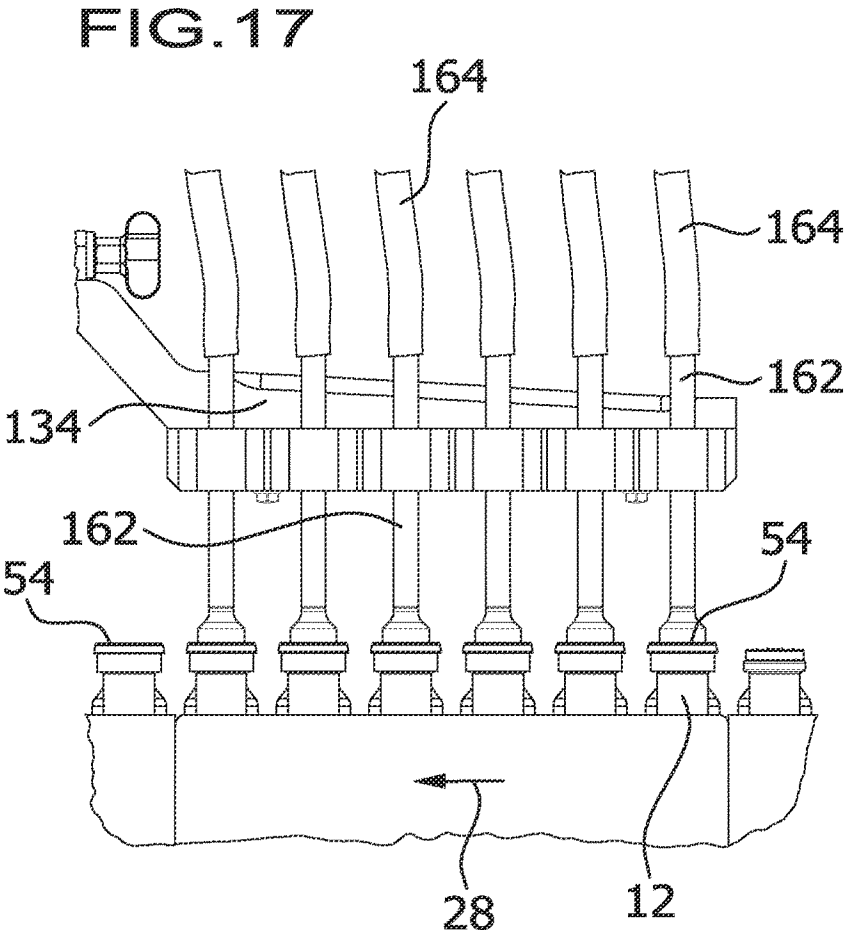
FIGS. 16 and 17 are detail views of the closing apparatus of FIG. 14, which show closure elements held by means of vacuum gripping elements before being lowered onto the containers (FIG. 16), or placed on the containers (FIG. 17)

The receiving body 76 is then transferred into the end position and the position close to the container (FIG. 14). The closure element 34 assumes the placed position.

The closing apparatus 42 furthermore comprises a respective gripping element 162 for gripping the closure element 34. The gripping element 162 is a vacuum gripping element to which a suction line 164 is connected. The gripping element 162 can also be referred to as a suction plunger.

A vacuum device 166 is provided to apply a negative pressure to the suction line 164 and the gripping element 162.

This allows the closure element 34 to be gripped by the gripping element 162. By deactivating the vacuum device 160, the closure element 34 can be removed from the receptacle 90. For this purpose, for example, an adjusting device 168, configured as a lifting device 170 (a displacement device), can be activated to lift the gripping element 162. Subsequently, in particular the receiving body 76 is pivoted back into the initial position.

Figure 16:
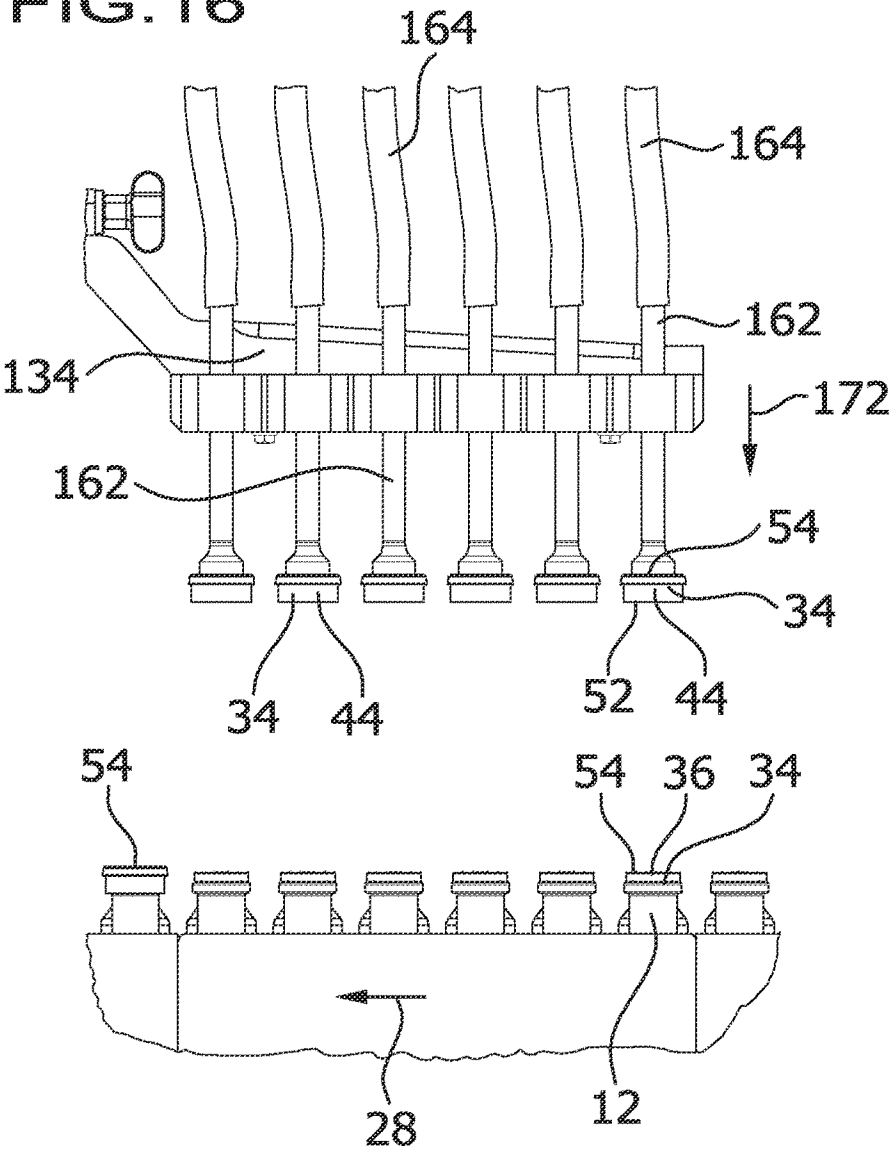

The gripping element 162 with the closure element 34 held thereon is lowered by means of the lifting device 170 in the direction of the container 12 with a mushroom plug 36 arranged thereon (arrow 172 in FIG. 16). The closure element 34 in the form of the crimp cap 44 is placed on the mushroom plug 36, and then the vacuum device 166 is deactivated to release the gripping element 162. The gripping element 162 can, for example, be lifted again by means of the lifting device 170.

It may be provided that the crimp cap 44 is pressed onto the container 12 with mushroom plug 36. Alternatively, the crimp cap 44 can just be placed loosely on top.

The closing apparatus 42 comprises a crimping station 174, arranged downstream in the transport direction 28, for crimping the crimp caps 44.

Figures 18, 19:
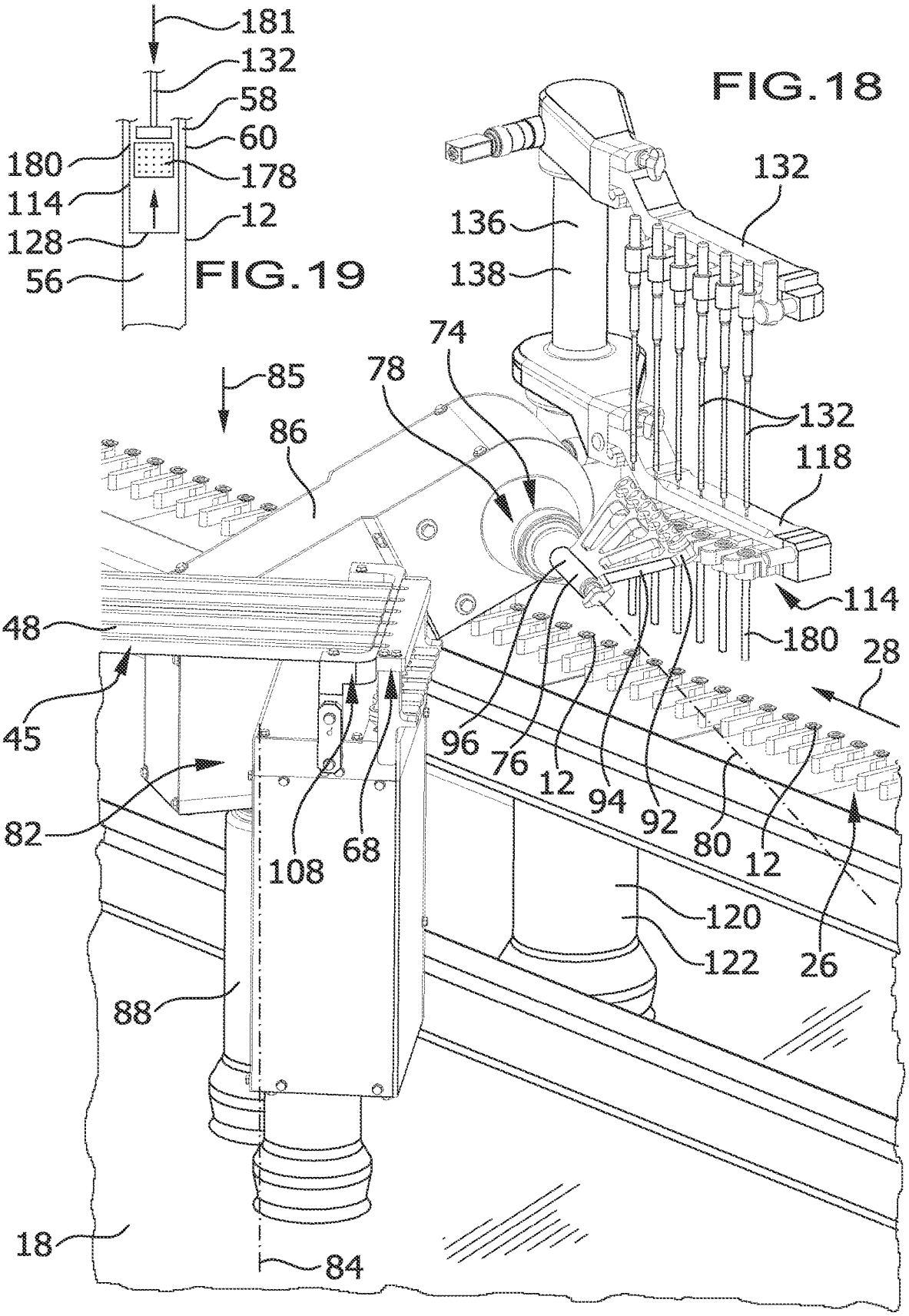
FIG. 18 is a perspective view of a closing apparatus in accordance with the present disclosure in a manner corresponding to FIG. 4, by means of which closing apparatus plunger stoppers can be arranged on the containers.
FIG. 19 is a schematic representation showing the arrangement of a plunger stopper via a holding body in a container opening.

FIG. 18 shows an advantageous embodiment of the closing apparatus in accordance with the present disclosure designated by reference numeral 176. The illustration corresponds to the illustration in FIG. 4.

The closing apparatus 176 is used for closing containers 12 by means of closure elements 34 in the form of plunger stoppers 178. The containers 12 may be syringes or carpules, for example.

As can be seen in FIGS. 18 and 19, a holding body 114 is also provided in the closing apparatus 176. The holding body 114 comprises a sleeve 180 assigned to a respective closure element 34. The sleeve 180 is dimensioned such that it can engage in the container opening 58 in the lowered state without contacting the edge 60.

The sleeve 180 forms the receptacle 116 for the closure element 34. The sleeves 180 are held on the support portion 118.

The insertion element 132 pushes the closure element 34, as in the case explained above, out of the receiving body 76 into the sleeve 180 and in so doing acts in particular as a pressing element which acts on the second face 54.

After lowering the sleeve 180 and the insertion element 132, the plunger stopper 178 is arranged within the container opening 58. The insertion element 132 acts on the second face 54 with a downward pointing retaining force and acts as a hold-down device for the plunger stopper 178 (arrow 181 in FIG. 19).

The sleeve 180 is raised with the lifting device 122. The plunger stopper 178 passes through the outlet opening 128 into the container opening 58, is expanded, and lays against the edge 60.

When closing with plunger stoppers 178, a pressing force on the container 12 can in this way be avoided. The supporting body 142 can also be omitted.

It is preferably possible to convert the closing apparatuses 32 and 176 into one another by means of a conversion. In this case, for example, the receiving bodies 76, the holding bodies 114, the insertion elements 132 and/or the support portions 134 are designed as format parts. By controlling the adjusting devices 120, 136 independently of one another, an adaptation to the containers 12 to be processed can in each case be made for the placing movement. With the system 10, in a preferred embodiment, there is no need for two complete closing apparatuses; instead, a convertible closing apparatus can be provided which is designed as a closing apparatus 32 or as a closing apparatus 176 depending on the containers 12.

Figure 21:
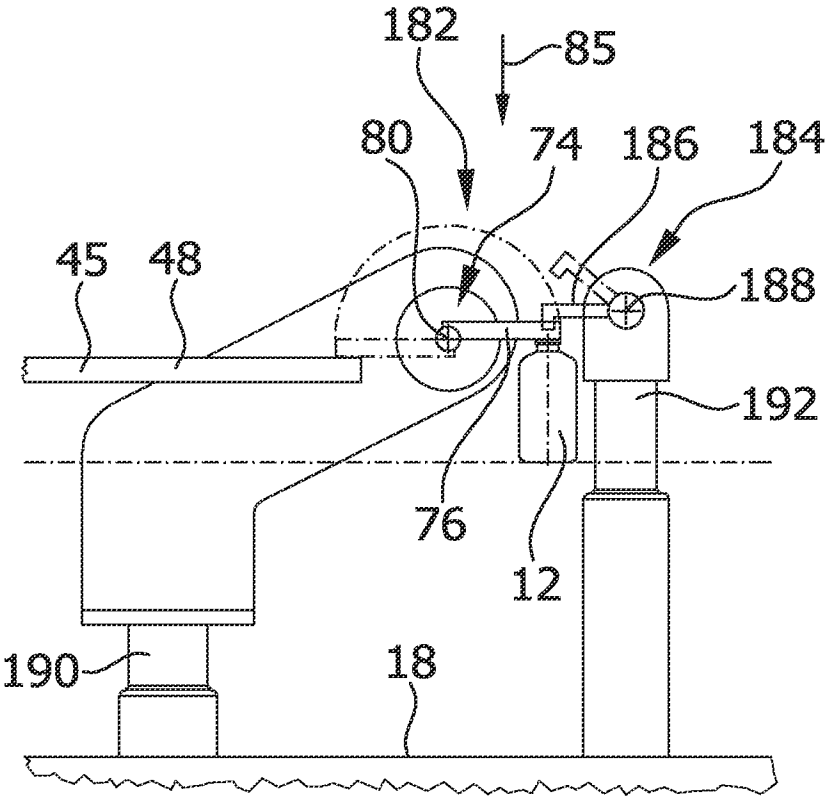
FIG. 21 is a representation corresponding to FIG. 20 while closing a different container.
Figure 20:
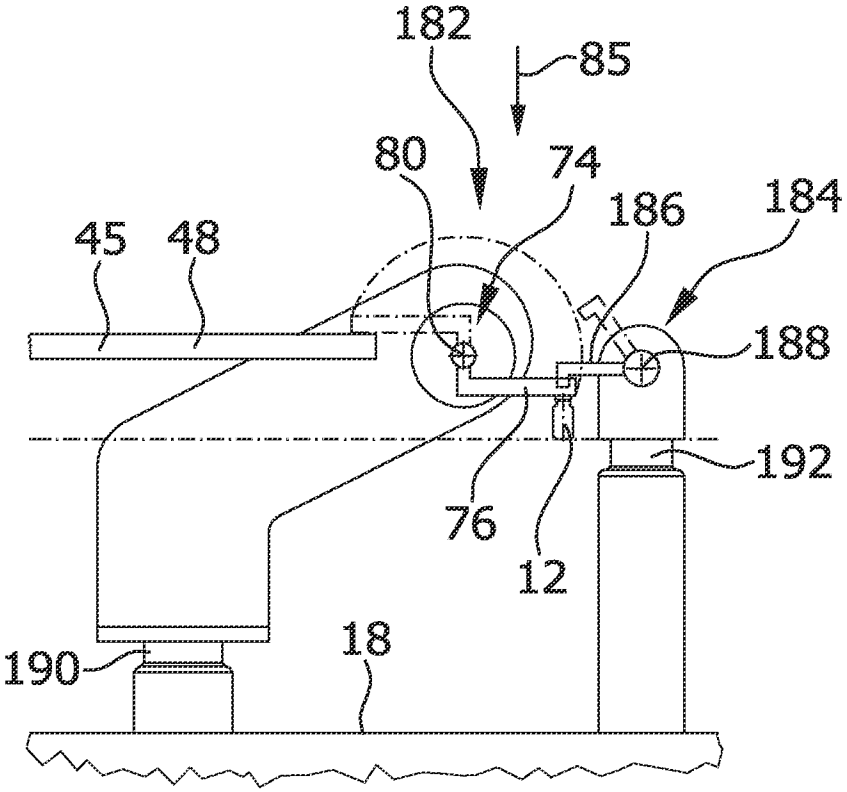
FIG. 20 is a schematic side view of a closing apparatus in accordance with the present disclosure.

FIGS. 20 to 21 show an advantageous embodiment of the closing apparatus in accordance with the present disclosure designated by reference numeral 182.

In the closing apparatus 182, the closure element 34 is transferred with the receiving body 76 in the end position thereof into a placed position in which the closure element 34 is already positioned on the container 12 and rests, for example, against the edge 60 thereof.

A pressing device 184 with a pressing element 186 is provided in order to press the closure element 34 into the container opening 58. In the example of the closing apparatus 182, the pressing element 186 is a pivot element which can be pivoted about a pivot axis 188 onto the closure element 34 by means of a drive. In an alternative embodiment, the pressing element 186 can, for example, be a thrust element which is pushed onto the closure element 34 in particular from above.

A lifting device for the closure elements and thus a lifting movement during operation can be omitted. Contamination due to abrasion can therefore be avoided, for example. The closing apparatus 182 is therefore in particular suitable for use with toxic or highly sensitive substances.

FIG. 21 shows the closing apparatus 182 for closing a different container 12 in comparison to FIG. 20. In this case, the container 12 is larger than in the example in FIG. 20.

The compensation in height can be achieved in that the closing apparatus 182 has a lifting device 190 already mentioned above, which is used in modifications. Alternatively or in addition, a lifting device 192 can be provided for the pressing element 186.

Figure 22:
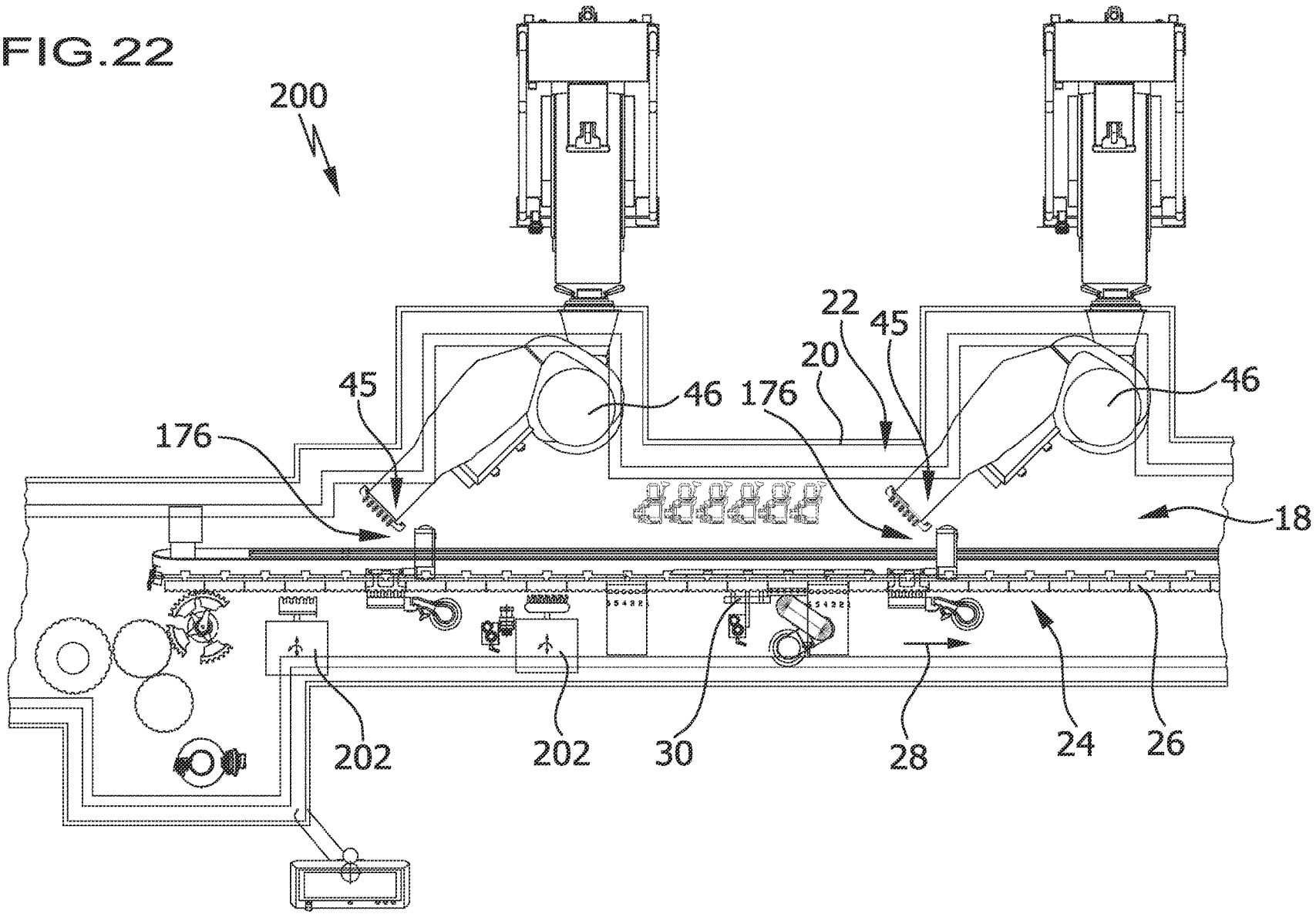
FIG. 22 is a schematic plan view of a system in accordance with the present disclosure with two closing apparatuses in accordance with the present disclosure.

FIG. 22 shows a plan view of a system in accordance with the present disclosure designated by reference numeral 200 in an advantageous embodiment. The illustration is analogous to the illustration in accordance with FIGS. 2 and 3.

The system 200 is used, for example, for processing containers 12 in the form of carpules. Here, as with the system 10, the filling station 30 is provided followed by a closing apparatus. In particular, the closing apparatus 176 is used here for arranging plunger stoppers 178.

Another closing apparatus is provided upstream of the filling station 30 in the transport direction 28. This apparatus is, for example, configured like the closing apparatus 176.

When processing the carpules, the container opening 58 of one face can first be closed with a plunger stopper 178 by means of the first closing apparatus in the transport direction 28. A turning station 202, with which the carpules are turned, follows in the transport direction 28. After filling, the respectively other container opening 58 is closed by means of an additional plunger stopper 178.

It is also conceivable that when carpules are closed, a combined crimp-stopper cap is placed in order to close them. This can take place in the closing apparatus before or after the filling station 30 in relation to the transport direction 28.

The invention claimed is:

1. A closing apparatus for closing pharmaceutical containers with closure elements, wherein the closure elements comprise a first face and a second face and, when the container is closed with the closure element, the first face faces a container interior and the second face faces away from the container interior, the closing apparatus comprising:

a feed unit with a feed path in which closure elements are feedable separately and at least partly without contacting the first face, at least one receiving body with a receiving body receptacle for the closure element, wherein the closure element is transferrable from the feed path into a receiving position in the receiving body receptacle;

a turning device for turning the at least one receiving body from an initial position into an end position and transferring the closure element from the receiving position into a placed position in which the closure element is positioned on the container or at a distance from the container such that the first face points in a direction of the container interior;

at least one holding body and at least one insertion element, wherein the closure element is, by means of the at least one insertion element, pushable out of the receiving body receptacle in the end position thereof into a holding body receptacle of the at least one holding body, wherein the second face of the closure element is able to be acted upon by means of the at least one insertion element by an insertion force in the direction of the holding body receptacle; and an adjusting device for moving the at least one holding body and a further adjusting device for moving the at least one insertion element in the direction of a container opening of the container, the adjusting device and the further adjusting device being configured to be controllable independently of one another, wherein the closing apparatus is convertible for an adaptation to different container types to be processed, with the at least one receiving body, the at least one holding body and the at least one insertion element being format parts adapted to the different container types, the at least one receiving body, the at least one holding body and the at least one insertion element comprising a first receiving body, a first holding body and a first insertion element, respectively, for processing closure elements that are mushroom plugs, and the at least one receiving body, the at least one holding body and the at least one insertion element comprising a second receiving body, a second holding body and a second insertion element, respectively, for processing closure elements that are plunger stoppers.

2. The closing apparatus according to claim 1, wherein at least one of the following applies:

in the feed path, the first face of the closure element is directed upward, wherein the feed path is free at the top;

in the feed path, the second face of the closure element rests on a base of the feed path.

3. The closing apparatus according to claim 1, wherein in the placed position, the closure element is arranged on the upper side of the container or above the container.

4. The closing apparatus according to claim 1, wherein the closing apparatus comprises a further insertion element via which the closure element arranged at one end of the feed path is insertable into the receiving body receptacle when the at least one receiving body is in the initial position, with the second face of the closure element is able to be acted upon via the further insertion element by an insertion force in the direction of the receiving body receptacle.

5. The closing apparatus according to claim 1, wherein at least one of the following applies:

the closure element is held in the receiving body receptacle by means of a force fit and/or positive engagement;

an outer edge of the closure element rests at least in sections against an edge of the receiving body receptacle.

6. The closing apparatus according to claim 1, wherein at least one of the following applies:

the receiving body receptacle comprises an insertion opening and an outlet opening opposite thereto for the closure element, wherein the closure element is movable through the insertion opening into the receiving body receptacle and through the outlet opening out of the receiving body receptacle;

the receiving body receptacle is sleeve-shaped and comprises a lateral aperture which is directed in the direction of the feed path when the at least one receiving body is in the initial position.

7. The closing apparatus according to claim 1, wherein the at least one receiving body comprises a suction line with a suction opening arranged on an edge of the receiving body receptacle, and wherein the closing apparatus comprises a vacuum device for applying negative pressure to the suction line, wherein the closure element is held in the receiving body receptacle by means of a negative pressure.

8. The closing apparatus according to claim 1, wherein the turning device is or comprises a pivot device by means of which the receiving body is pivotable about a pivot axis for transferring from the initial position into the end position.

9. The closing apparatus according to claim 8, wherein a pivot angle for pivoting from the initial position into the end position is 180° or substantially 180°, and/or wherein a height of the closure element, is the same or substantially the same in the receiving position and in the placed position.

10. The closing apparatus according to claim 1, wherein the feed path defines a feed direction for the closure elements, and a transport device is provided for the containers which are transportable with the transport device in a transport direction to the closing apparatus, wherein an angle between the feed direction and the transport direction is approximately 40° to 60°.

11. The closing apparatus according to claim 1, wherein the turning device comprises or forms a pivot device for pivoting the at least one receiving body about a pivot axis and transferring the at least one receiving body from a position remote from the container to a position close to the container, in which position a distance of the receiving body from the container is less than in the position remote from the container.

12. The closing apparatus according to claim 11, wherein the at least one receiving body is transferable from the initial position into the end position while the turning device is pivoted from the position remote from the container into the position close to the container.

13. The closing apparatus according to claim 1, wherein the closing apparatus comprises a pressing device for pressing the closure element onto the container or for pushing the closure element into a container opening, and/or wherein the closing apparatus comprises a supporting body for supporting the container with a force directed counter to a pressing force of a pressing device, wherein the container stands on the supporting body at least during the pressing of the closure element.

14. The closing apparatus according to claim 13, wherein at least one of the following applies:

the closure element is held in the holding body receptacle by means of a force fit and/or positive engagement;

an outer edge of the closure element rests at least in sections against an edge of the holding body receptacle.

15. The closing apparatus according to claim 13, wherein at least one of the following applies:

the holding body receptacle comprises an insertion opening and an outlet opening opposite thereto for the closure element, wherein the closure element is movable through the insertion opening into the holding body receptacle and through the outlet opening out of the holding body receptacle;

the holding body receptacle is sleeve-shaped and comprises a lateral aperture.

16. The closing apparatus according to claim 13, wherein the second holding body is or comprises at least one tube or sleeve and is dimensioned such that the at least one tube or sleeve is insertable into the container without contacting an edge of a container opening.

17. The closing apparatus according to claim 13, wherein the closure element is placeable against an edge of the container opening by means of the at least one holding body, and wherein the closure element is pressable by means of the at least one insertion element out of the holding body receptacle into the container opening for closing the container.

18. The closing apparatus according to claim 13, wherein the adjusting device is a displacement device for displacement of the at least one holding body and/or wherein the further adjusting device is a displacement device for displacement of the at least one insertion element.

19. The closing apparatus according to claim 18, wherein the at least one holding body and the at least one insertion element are removable from the container by means of the adjusting device and the further adjusting device, respectively, wherein the at least one holding body is removable from the container before the at least one insertion element is displaced.

20. The closing apparatus according to claim 18, wherein the second holding body with the received closure element engages in the container opening and the second insertion element forms a hold-down device for applying a retaining force to the closure element, and wherein the second holding body is meanwhile removable from the container by means of the further adjusting device so that the closure element is displaceable out of the holding body receptacle to remain in the container opening.

21. The closing apparatus according to claim 1, wherein the closure element rests against a container opening in the placed position, and wherein the closing apparatus comprises a pressing device with a pressing element formed by the first insertion element which presses the closure element into the container opening or presses it onto the container and acts on the second face with a pressing force.

22. The closing apparatus according to claim 1, wherein the closing apparatus comprises at least one monitoring device with which the closure element is checkable for its presence and/or correct seat on the container.

23. The closing apparatus according to claim 1, wherein a configuration of the closing apparatus for simultaneously closing a plurality of containers with a respective closure element is provided.

24. A system for processing pharmaceutical containers being vials, syringes and/or carpules, comprising a transport device for transporting the containers along at least one transport direction, a filling station arranged at the transport device for filling a pharmaceutical substance into the containers, and a closing apparatus, arranged downstream of the filling station in a transport direction, for closing the containers after filling with closure elements, wherein the closure elements comprise a first face and a second face and, when the container is closed with the closure element, the first face faces a container interior and the second face faces away from the container interior, wherein the closing apparatus comprise a feed unit with a feed path in which closure elements are feedable separately and at least partly without contacting the first face, at least one receiving body with a receiving body receptacle for the closure element, wherein the closure element is transferrable from the feed path into a receiving position in the receiving body receptacle, and a turning device for turning the at least one receiving body from an initial position into an end position and transferring the closure element from the receiving position into a placed position in which the closure element is positioned on the container or at a distance from the container such that the first face points in a direction of the container interior;

at least one holding body and at least one insertion element, wherein the closure element is, by means of the at least one insertion element, pushable out of the receiving body receptacle in the end position thereof into a holding body receptacle of the at least one holding body, wherein the second face of the closure element is able to be acted upon by means of the at least one insertion element by an insertion force in a direction of the holding body receptacle; and an adjusting device for moving the at least one holding body and a further adjusting device for moving the at least one insertion element in the direction of a container opening of the container, the adjusting device and the further adjusting device being configured to be controllable independently of one another;

wherein the closing apparatus is convertible for an adaptation to different container types to be processed, with the at least one receiving body, the at least one holding body and the at least one insertion element being format parts adapted to the different container types, the at least one receiving body, the at least one holding body and the at least one insertion element comprising a first receiving body, a first holding body and a first insertion element, respectively, for processing closure elements being mushroom plugs, and the at least one receiving body, the at least one holding body and the at least one insertion element comprising a second receiving body, a second holding body and a second insertion element, respectively, for processing closure elements being plunger stoppers.

25. The system according to claim 24, wherein the system comprises a setup device on which the closing apparatus is arranged for closing the containers and the transport device, and an isolator device covering the closing apparatus and the transport device with a cover element, for providing at least one of a protective and a decontaminating atmosphere between the cover element and the setup device.

26. The system according to claim 24, wherein the system comprises an additional closing apparatus for closing the containers, which apparatus is downstream of the first mentioned closing apparatus in the transport direction, for additionally closing containers, by means of closure elements in the form of crimp caps, and wherein the system comprises a crimping station, arranged downstream in the transport direction, for crimping the crimp caps.

27. The system according to claim 24, wherein the system, at the transport device, comprises an additional closing apparatus for closing the containers and a turning station which are arranged upstream of the filling station in the transport direction, wherein a first container opening is closeable by means of a closure element of the additional closing apparatus, after which the containers are turned by means of the turning station and subsequently filled by means of the filling station.

28. A closing apparatus for closing pharmaceutical containers with closure elements, wherein the closure elements comprise a first face and a second face and, when the container is closed with the closure element, the first face faces a container interior and the second face faces away from the container interior, the closing apparatus comprising:

a feed unit with a feed path in which closure elements are feedable separately and at least partly without contacting the first face, a receiving body with a receiving body receptacle for the closure element, wherein the closure element is transferrable from the feed path into a receiving position in the receiving body receptacle;

a turning device for turning the receiving body from an initial position into an end position and transferring the closure element from the receiving position into a placed position in which the closure element is positioned on the container or at a distance from the container such that the first face points in a direction of the container interior; and a gripping element for gripping the closure element assuming the placed position, a vacuum device by which a negative pressure is applicable to the gripping element for removing the closure element from the receiving body receptacle, and an adjusting device for moving the closure element with the gripping element to the container, wherein the closure element is placeable on the container when the negative pressure is not applied, wherein the adjusting device is a displacement device for moving the gripping element in a straight line.

* * * * *